United States Patent [19]

Jennens

[11] Patent Number: 4,713,896

[45] Date of Patent: Dec. 22, 1987

[54] INSHORE SUBMERSIBLE AMPHIBIOUS MACHINES

[76] Inventor: Eric G. Jennens, 1978 McDougall Street, Kelowna, British Columbia, Canada, V1Y 1A3

[21] Appl. No.: 773,181

[22] Filed: Sep. 6, 1985

Related U.S. Application Data

[63] Continuation-in-part of Ser. No. 631,764, Jul. 17, 1984, abandoned, and a continuation-in-part of Ser. No. 478,882, Mar. 23, 1983, abandoned, and a continuation-in-part of Ser. No. 358,602, Mar. 15, 1982, abandoned, and a continuation-in-part of Ser. No. 249,602, Apr. 10, 1981, abandoned.

[51] Int. Cl.[4] ..... B63G 8/00

[52] U.S. Cl. ..... 37/54; 56/9; 91/51; 114/333; 114/337; 114/312; 114/270

[58] Field of Search ..... 37/54, 56, 58; 114/334, 114/335, 270, 312, 274, 336, 337, 333; 244/31; 91/51; 400/179; 440/113; 56/8, 9

[56] References Cited

U.S. PATENT DOCUMENTS

| | | | |
|---|---|---|---|
| 581,213 | 4/1897 | Lake | 114/335 X |
| 659,703 | 10/1900 | Soblik | 400/179 X |
| 687,830 | 12/1901 | Kirk | 37/56 X |
| 785,263 | 3/1905 | Macdonell | 37/54 X |
| 813,935 | 2/1906 | Avery, Jr. | 37/56 X |
| 867,984 | 10/1907 | Lake | 37/56 X |
| 1,854,026 | 4/1932 | Gamba | 114/53 |
| 2,000,746 | 5/1935 | Dray | 114/336 |
| 2,014,389 | 9/1935 | Lord | 37/56 X |
| 2,519,453 | 8/1950 | Goodman | 114/335 X |
| 2,707,084 | 4/1955 | Mills, Jr. | 114/270 |
| 3,034,628 | 5/1962 | Wadey | 400/179 X |
| 3,171,219 | 3/1965 | Kaufmann et al. | 37/56 |
| 3,543,526 | 12/1970 | O'Neill et al. | 114/334 X |
| 3,651,775 | 3/1972 | Kock | 114/274 |
| 3,683,521 | 8/1972 | Sloan et al. | 37/67 X |
| 3,800,722 | 4/1974 | Lepage | 114/333 |
| 3,822,558 | 7/1974 | Blankenship | 37/64 X |
| 3,919,923 | 11/1975 | Haigh | 91/51 |

OTHER PUBLICATIONS

"The Skyhook", *Washington Star-News,* p. A-10, Feb. 5, 1975.

*Primary Examiner*—Clifford D. Crowder

[57] ABSTRACT

A submersible unit comprises a portable, open or closed bottomed pneumatic chamber mounted on flexible drive tracks controlled by personnel from the chamber for operation along the bottom of a body of water, on the surface, at intermediate levels, in the air and on land. A safety chamber, connected to the submersible unit by an extendable linkage, can limit the depth of submergence of the submersible unit, stores cargo and carries power. Flooded compartments in the submersible unit and the safety chamber are supplied with compressed air to control the supported load and depth of submergence. Various accessories carried by the underwater unit enable the performance of a number of different on and under the water and land based tasks. A special pneumatic circuit enables equipment and propulsion to be controlled by touch control panels. A majority of operations are contained within the machine to minimize contamination of surrounding areas.

57 Claims, 31 Drawing Figures

FIG. 16
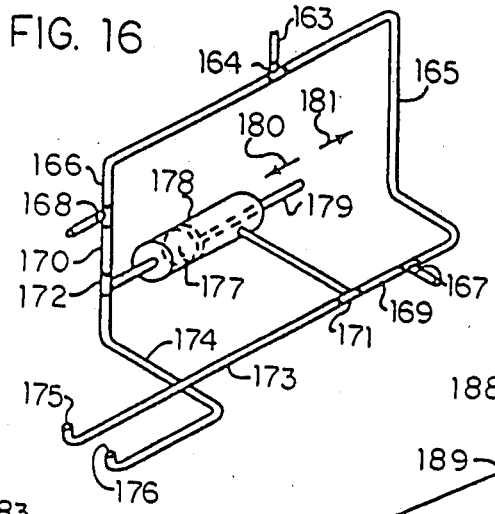
FIG. 17
FIG. 18
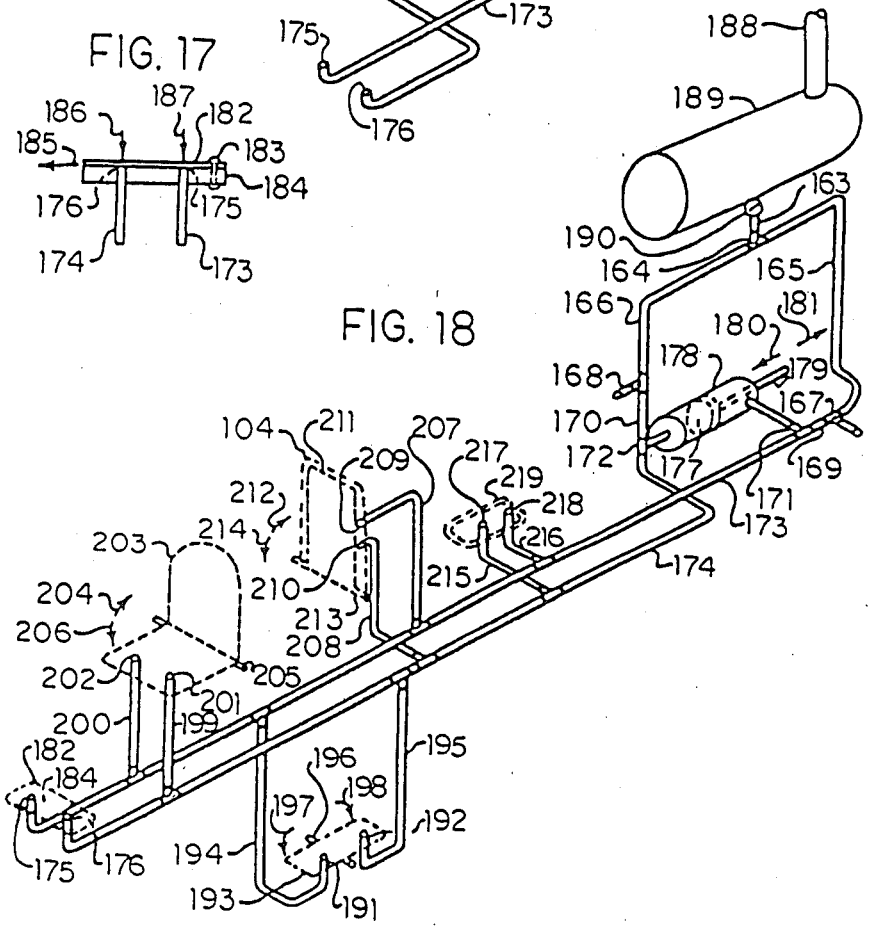

INSHORE SUBMERSIBLE AMPHIBIOUS MACHINES

This is a continuation-in-part of the prior application Ser. No. 631,764 filed July 17, 1984; Ser. No. 478,882 filed Mar. 23, 1983; Ser. No. 358,602 filed Mar. 15, 1982 and Ser. No. 249,602 filed Apr. 10, 1981, by Eric Gordon Jennens, entitled "Inshore Submersible Amphibious Machines" all now abandoned.

This invention relates to inshore submersible amphibious machines capable of permitting the crew to carry out underwater work or observations in confortable atmospheric conditions.

Prior art submersible equipment relies on pipelines, conveyor belts, wharves, cables, cranes, slipways, other vessels and/or vehicles or other conventional means in order to receive and/or transfer materials, supplies equipment, crew, communications and/or power from, and up onto shore to to other vessels or vehicles. All of these means require extra equipment and personnel, added expense and additional time, especially to set up and take apart.

Prior art equipment also generally requires the crew to be in an entirely enclosed compartment, equipped with a pressurized air-water lock chamber by which the crew, clothed in diver's gear, may enter or exit the compartment.

An object of the invention is to provide an underwater work vehicle which substantially alleviates the disadvantages of the prior art.

According to the present invention there is provided a self-contained, free ranging vehicle capable of travelling on land, in the air, on the water and underwater, comprising: ground-engaging driving means for travelling on land, along the floor of a body of water and to assist in propulsion when off the floor of a body of water; a power unit providing motive power to said vehicle on land, in the air, underwater and on the water; a capsule comprised of one or more open or closed bottomed pneumatic chambers permitting the crew inside to make observations or carry out work underwater in comfortable atmospheric conditions with unobstructed access to the surrounding water and to the floor of a body of water; and control station from where an operator can drive said vehicle in comfortable atmospheric conditions when it is travelling on land, in the air, on the water and underwater, including driving said vehicle directly from a point on land to any location underwater; means for accommodating the crew in said capsule as said vehicle travels underwater; and means for continuously providing sufficient air pressure in said capsule to maintain said comfortable atmospheric conditions underwater, whereby the crew can enter said capsule on dry hand and remain therein, with unobstructed access to the exterior of the vehicle.

When necessary this vehicle may be equipped with a safety chamber, and is able to carry all of its own requirements. Said vehicle is capable of travelling on land, in the air, in water, on the floor of a body of water, on the surface, and to and from all locations in between.

The vehicle may be propelled and/or maneuvered by tracks or other means operated from the self-contained portable capsule and/or from the propulstion unit and/or from the safety chamber. the safety chamber, when supplied is capable of preventing all the submersible apparatus from sinking to a dangerous depth when said submersible apparatus is underwater.

The capsule and propulsion unit should normally be sufficiently heavy to hold itself down on the floor of a body of water, as required. Being self-contained, the vehicle does not require the assistance of external support personnel or equipment.

The vehicle can undertake numerous activities on land, in the air, on and below the surface of a body of water, on and in the floor of a body of water and at any and all locations in between. The movement of personnel, equipment and supplies to and from the bottom of a body of water, to and from land locations and any and all locations in between can be done more efficiently, as well as the relocation of materials and equipment without the assistance of other support equipment, vessels, additional personnel, expense and time as required in the prior art. Small jobs become less time consuming and more economical without restriction as to the terrain covered.

The inshore submersible amphibious machine, hereafter referred to an ISAM and/or vehicle, is extremely versatile, having a high degree of mobility on different types of terrain on the floor of a body of water, on land, in the air and at all locations in between.

The capsule, containing the pneumatic chamber, is provided with a continual supply of air to keep out water as the capsule progresses into the water, enabling the crew to remain in normal working clothes and to physically work and/or observe and/or utilize the equipment on or under the surface of a body of water right where the operation is as well as in and/or on the floor of a body of water, hereafter referred to as "aqua soil".

When a safety chamber is provided its operation can be controlled by the crew in the capsule. Said safety chamber can be arranged to automatically float off or settle onto the propulsion unit, hereafter referred to as the "propulsion unit", as the propulsion unit proceeds into or out of the water. This is accomplished without the assistance of other equipment, vessels or individuals, as in prior art. When the propulsion unit is submerged the safety chamber, being attached to said propulsion unit, may float on the surface of the water or remain stationary on the propulsion unit. The functions of the safety chamber include stability, buoyancy control, supplying, receiving, discharging and transferring everything the ISAM requires.

In a preferred embodiment, the capsule and propulsion unit may surface at any time, to become an open or closed bottomed boat, without having to travel up a slope in the aqua soil. The propulsion unit automatically settles below the safety chamber so that part or all of the power of ISAM is used to propel said ISAM in all directions. The propulsion unit, with capsule attached, may return to the aqua soil at any time or operate anywhere in between.

The propulsion unit and capsule can operate without the safety chamber attached for certain applications, such as in shallow waters where there is no necessity for a safety chamber.

The ISAM provides a controlled environment where individuals and equipment can function more efficiently on site without the need for special clothing.

The ISAM may have all the equipment necessary to allow all the small material being removed from the aqua soil areas or the small materials being taken down from the surface to the underwater components to be contained entirely within an enclosed system to prevent their drift and/or the contamination of the water.

The invention will now be described in more detail, by way of example only, with reference to the accompanying drawings, in which:

FIG. 16 is a perspective view of a detail of an arrangement for the utilizing of compressed air for the operation of a control system;

FIG. 17 is a front elevation in section of a control pane;

FIG. 18 is a perspective view of one control system to control a motor, with two emergency shut-down features and remote control panel;

The ISAMs illustrated in FIGS. 1 to 31 are in the embodiments as illustrated and are not necessarily in the only embodiment in which the invention can be employed. Wherever the singular is used herein the same shall be construed as including the plural and vice versa.

Figure 1:
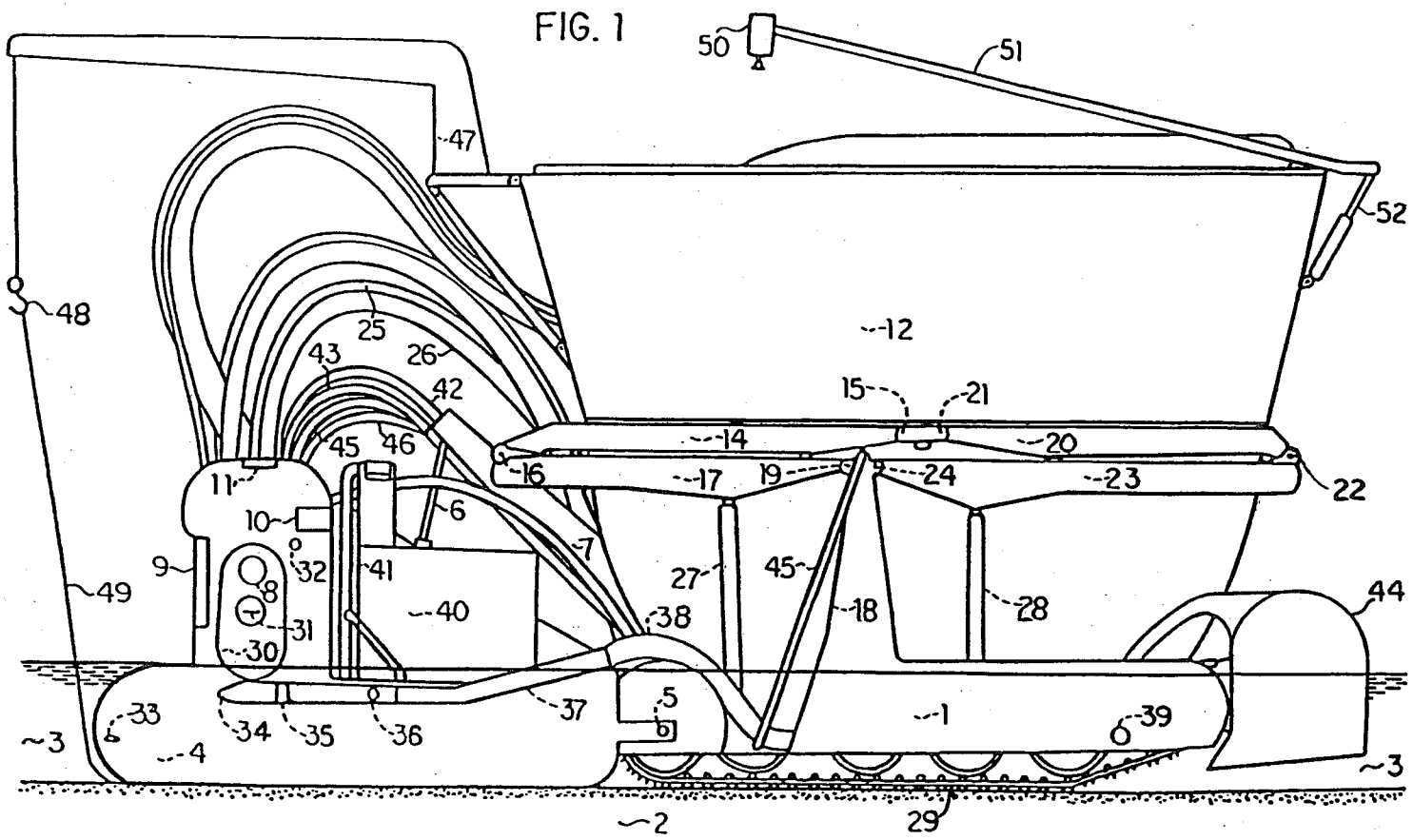
FIG. 1 is a side elevation of one embodiment of ISAM, partly submerged, in the retracted position on aqua soil.

In the embodiment shown in FIG. 1, propelling unit 1 is used for propelling ISAM in all directions on aqua soil 2 in water 3. The attached capsule 4, in the form of open or closed bottomed pneumatic chambers, hereafter referred to as "capsule", within which crew can work and/or observe, is raised and lowered at hinge point 5 by the pull or push of cylinders 6 attached to gooseneck 7 or other means. The crew has full control over capsule 4 regarding height adjustments for maneuverability over objects, inclines or for other reasons. Along with the downward visibility through the open-bottomed capsule, the crew has full visibility by utilizing windows 8, 9, 10 and 11, or other means. Capsule 4 can also be moved from one location to another on land, in the air, in the water or on the aqua soil by other forces independent of vehicle 1, and/or safety chamber 12.

Figure 2:
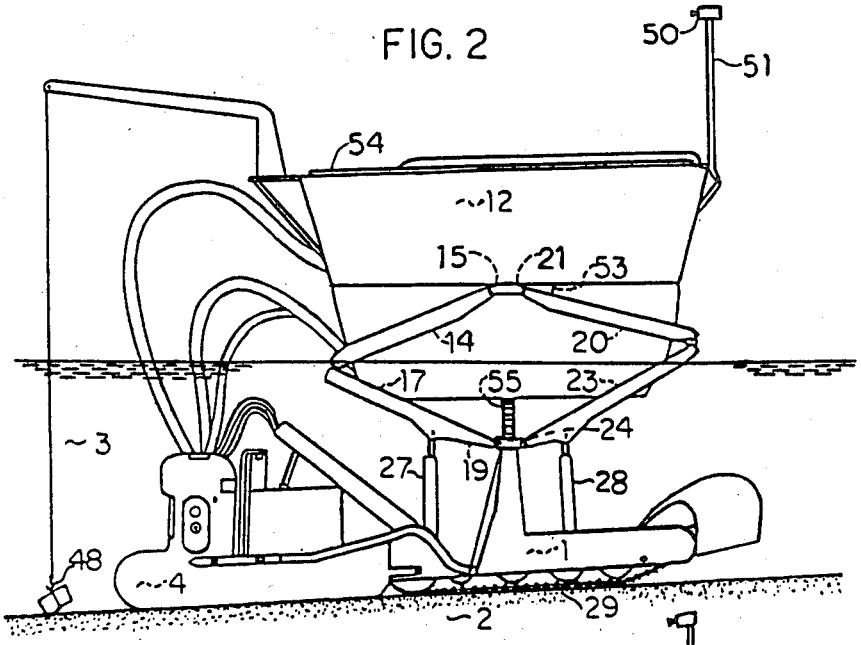
FIG. 2 is a side elevation of ISAM in a semi-extended position in medium depth water, showing the safety chamber after it has floated off the propulsion unit, a crane for removing debris from the aqua soil, and a closed circuit T.V. camera in its fully extended position.

When desired, safety chamber 12, FIG. 2, automatically floats off propulsion unit 1 as it progresses into deeper water 3. When approaching shallow water 3, FIG. 1, safety chamber 12 automatically settles onto propulsion unit 1. Scissor Type linkage arms or other means, when fully extended, govern the maximum distance propulsion unit 1 and capsule 4 can be below the surface of water 3 when safety chamber 12, FIG. 2, remains on the surface of the water. One set of arms 14, FIG. 1, are hinged at point 15 on safety chamber 12. The opposite end of arms 14 are attached at hinge point 16 to arms 17. The opposite end of arms 17 are attached to vehicle arms 18 at hinge point 19. Arms 20 hinge at point 21 on safety chamber 12. The opposite end of arms 20 are attached at hinge point 22 to arms 23. The opposite end of arms 23 are attached to vehicle arms 18 at hinge point 24.

Flexible hoses 25 and 26 can be used to transfer material such as pressurized air, hydraulics and electrical etc., from safety chamber 12 to capsule 4.

Cylinders 27 and 28 control the raising and lowering of linkage arms 14, 17, 20 and 23, and can control the raising, lowering and tilting of the underwater components.

Propulsion unit 1 is propelled by endless flexible track 29 or by other means.

Door 30, or other means, is used for the passage of crew and/or equipment into or out of capsule 4. Handle 31 or other means is used to open door 30 from the inside or outside of capsule 4.

In the open-bottomed pneumatic chamber capsule 4, the air pressure above the bottom edge is maintained at a higher pressure to keep the water out. Consequently in an emergency the crew would find difficulty in opening door 30 when submerged. Through the wall of capsule 4 is ventilating hole 32. Either the crew inside or the rescuer on the outside can open hole 32 mechanically. Once hole 32 is opened the water automatically rises in capsule 4 to the level of hole 32. With hole 32 near the top of door 30 the internal and external pressures are balanced allowing door 30 to be opened easily. An air pocket is formed above hole 32 giving the crew sufficient reserve air to allow time for escape. Since the electronic equipment is located above hole 32 electrical and communication functions can continue while escape proceures are taking place.

Figure 3:
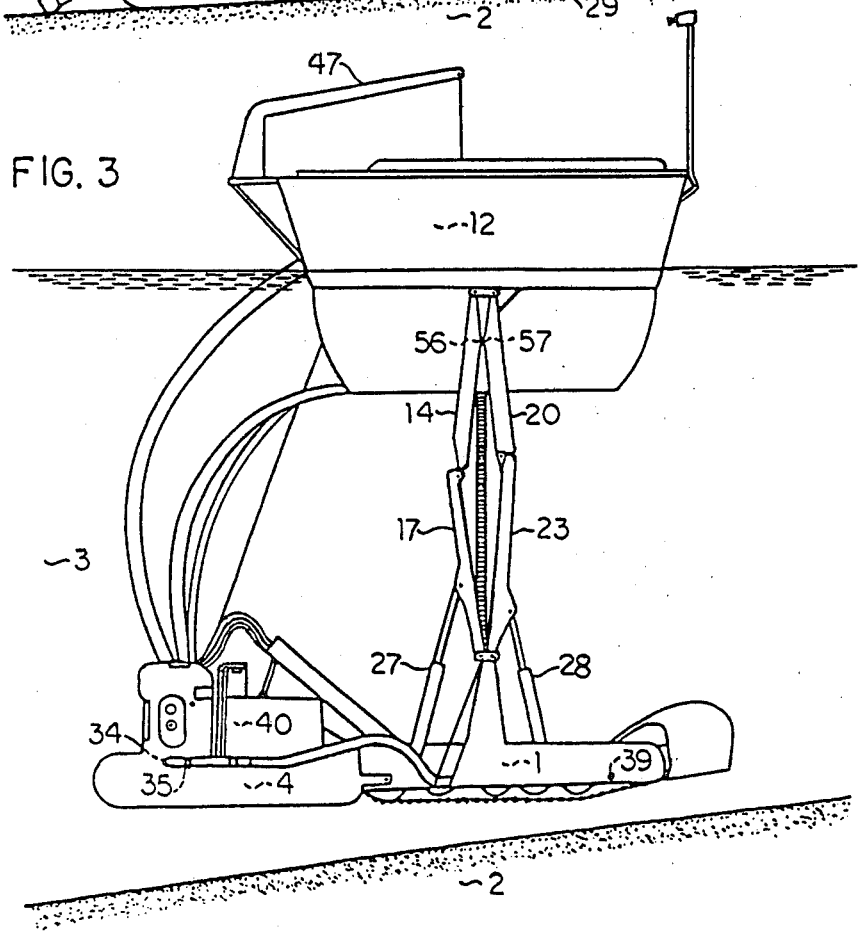
FIG. 3 is a side elevation of ISAM in its fully extended position after the capsule and propulsion unit have floated off the aqua soil, the crane being shown rotated aft to unload its debris into the safety chamber's storage basket.
Figure 5:
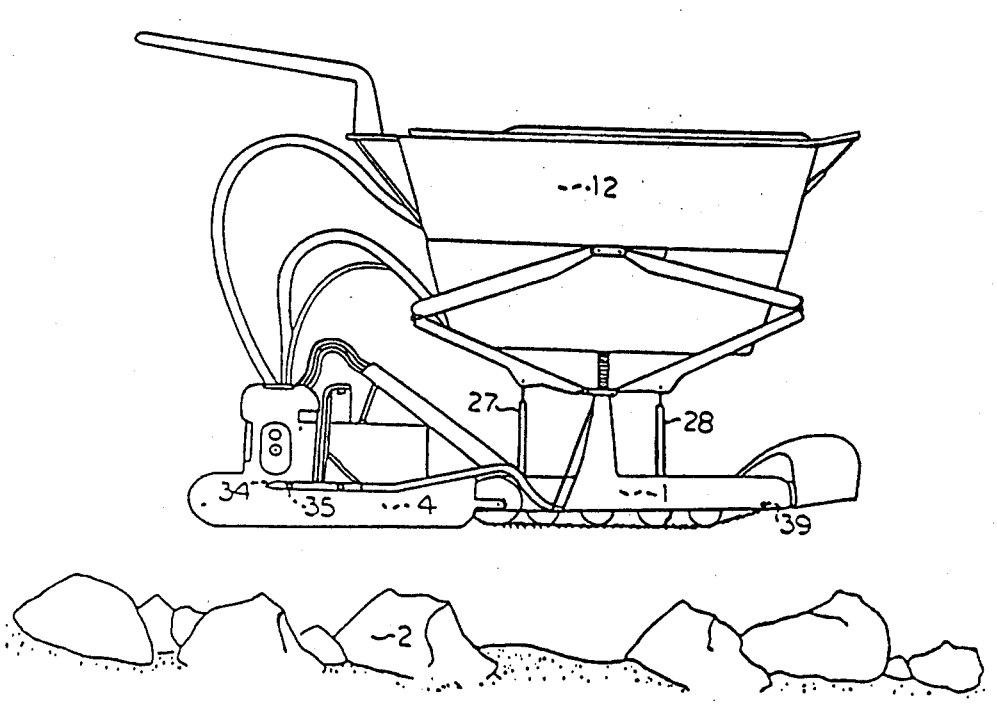
FIG. 5 is a side elevation of ISAM showing its capsule and propulsion unit being lifted off the aqua soil.
Figure 6:
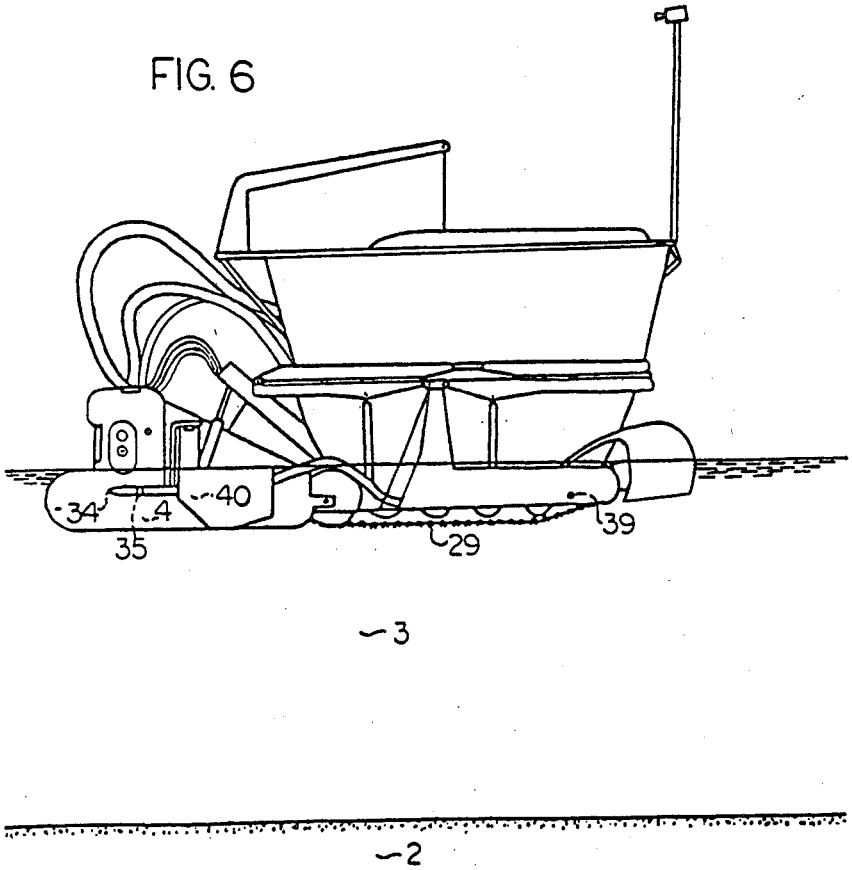
FIG. 6 is a side elevation of ISAM in its full floating configuration, with side stabilizing floats extended and the crane facing aft.
Figure 9:
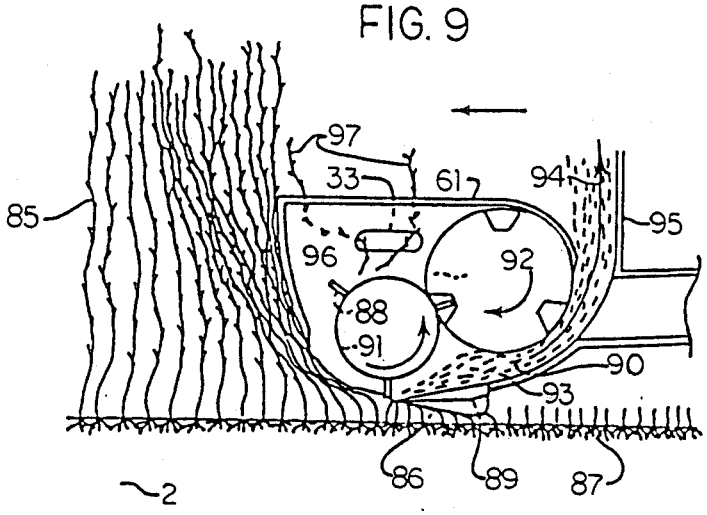
FIG. 9 is a side elevation in section of a detail of a part of ISAM referred to as the mower pump.

Intake 33 is for stray plant and/or particle pick up described in FIG. 9. Opening 34, FIG. 1, is a water pressure discharge opening to jet water foreward assisting in directional control especially when ISAM is in the full floating configuration as shown in FIGS. 3, 5 and 6, or anywhere in between. Clear water intake 35, FIG. 1, is for side water pick up to give the crew the choice of taking clearer water from either side of ISAM, such as the side away from aquatic plants or the side already cleared, which would keep the water clearer for the water systems. When ISAM is in the full floating configuration, FIGS. 3, 5 and 6, or anywhere in between, intake 35 creates a suction on one side or the other of ISAM to assist in directional control. Opening 36, FIG. 1, has the same function as opening 34, discharging on the sides of capsule 4, but providing rearwardly directed jets of water. Pipe 37 transfers water aft under pressure into flexible hose 38. Hose 38 flexes to allow for the tilting of capsule 4 at hinge point 5. The final discharge of this pressurized water occurs at opening 39 giving a jet thrust perpendicular to the side of the stern, FIGS. 3, 5 and 6.

Side stabilizing floats 40 swing outward on arms 41. They can be retracted and flooded so as to sink with capsule 4 when propulsion unit 1 travels down on the aqua soil 2.

Stability in the ISAM is regulated, in part, through control of ballast tanks. Hose 42 carries compressed air to the main ballast tanks in propulsion unit 1. Hose 43 carries air to the rear ballast tanks and plow chamber 44. Hoses 45 and 46 carry air to vehicle arms 18. Separately regulating the buoyancy in vehicle arms 18 will prevent track 29 from sliding down a side slope.

Crane 47 is mounted on the front of safety chamber 12 so that the crew in capsule 4 can utilize it to the best advantage. Hook 48 can be pulled in under capsule 4 by tether 49 so the crew can fasten a basket, clam shell or other means to hook 48 to retrieve or place objects. These activities can be accomplished from within capsule 4 or just below it.

T.V. camera 50 or other means is mounted on boom 51 which can be tilted up by control 52. Camera 50 is described more fully in FIGS. 2 and 7.

FIG. 2 shows that propelling unit 1 and capsule 4 have traveled into deeper water 3. When safety chamber 12 becomes buoyant enough, it floats on the surface of water 3 and consequently linkage arms 14, 17, 20 and 23 extend. From this point, up to and including when the underwater units are lifted off aqua soil 2, FIG. 3, any time the underwater units are at a point of upsetting, safety chamber 12 being unable to submerge without flooding its ballast tanks, prevents such an upset from occurring. Cylinders 27 and 28, FIG. 2, can increase and decrease the pressure of track 29 on aqua soil 2 by transferring the weight of safety chamber 12 to track 29. To do this they partly or wholly lift safety chamber 12 out of the water so that its weight acts on propulsion unit 1. The weight of safety chamber 12 can be increased by filling it with water such as in ballast tank 58, FIG. 8, or by other means. Camera 50, FIG. 2, is set at a suitable height on its boom 51 to be used as a navigational aid, with a panoramic view of the operation above water 3. The crew below the surface, in capsule 4, can observe this operation on the crew's monitor. Locking device 53 attached to arm 20 and to safety chamber 12 automatically locks whenever hook 48 has a load or if basket 54 tilts its load when safety chamber 12 is in the floating position. Locking device 53 prevents safety chamber 12 from pivoting at points 15 and 21, therefore safety chamber 12 pivots at hinge points 19 and 24 preventing an upset. Extendible hose 55 extends and will be described more fully with FIG. 8.

FIG. 3 shows linkage arms 14, 17, 20 and 23 in their fully extended position. Propulsion unit 1 and capsule 4 have been lifted off aqua soil 2 and are supported by safety chamber 12. This prevents loss of all the equipment into deep water. Stops 56 and 57 prevent the interior angles between arms 14, 17, 20 and 23 from reaching 180°. This allows the arms to fold together more easily when ISAM reaches shallower water or surfaces by either emptying the water from ballast tanks in capsule 4 and/or propulsion unit 1 or by retracting cylinders 27 and 28. Crane 47 is swung aft to be in a more stable position while the entire ISAM is in the fully floating configuration. When propulsion unit 1 and capsule 4 surface, stabilizing floats 40 extend outward. The water is blown out of them with compressed air. Floats 40 give ISAM more side stability when it is on the surface of water 3 in its fully floating position, as shown in FIG. 6.

Figure 4:
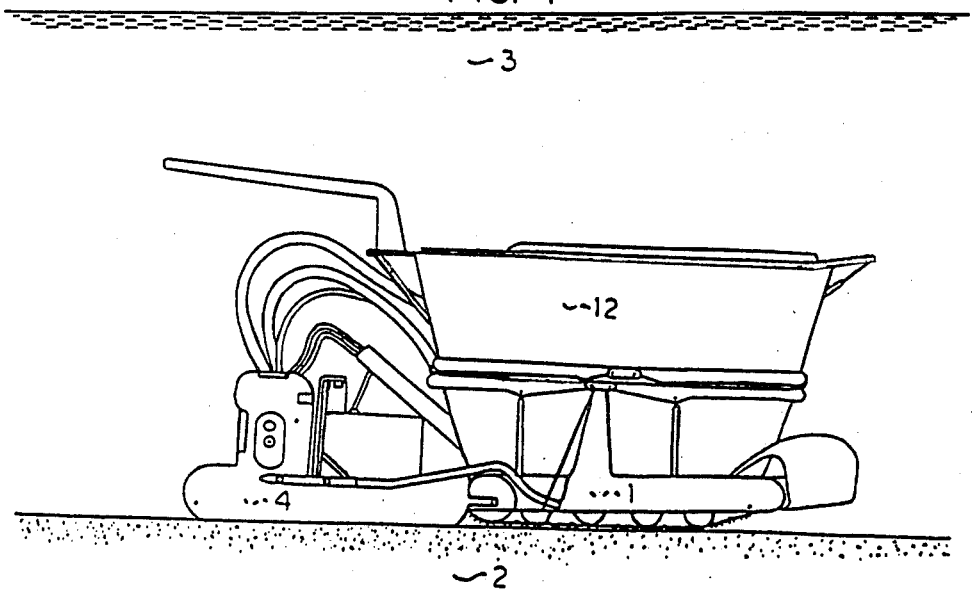
FIG. 4 is a side elevation of ISAM showing its safety chamber fully submerged allowing the vehicle to travel deeper in the water.

FIG. 4 depicts ISAM travelling underwater, on aqua soil 2, with safety chamber 12 secured onto propulsion unit 1. Ballast tank 58, FIG. 8, and tank 67 are flooded or partially flooded to allow safety chamber 12, FIG. 4, to submerge to propulsion unit 1 and capsule 4 into upper water 3 than when the linkage system is fully extended as in FIG. 3. The engine room 161, FIG. 8, and any other air filled compartment, being above propulsion unit 1, FIG. 4, create the upward force giving a lower center of gravity to maintain stability. The compressed reserve air in tank 162, FIG. 8, within safety chamber 12, FIG. 4, can be released, or other means used, to blow out ballast tank 58, FIG. 8, and tank 67 in order to surface.

FIG. 5 shows ISAM underwater hovering over the rough terrain of aqua soil 2. Propulsion unit 1 may not be capable of travelling on such a rough surface so propulsion unit 1 and capsule 4 are lifted either by cylinders 27 and 28 or by increasing the buoyancy of ballast tank 58, FIG. 8, tank 67 and/or the penumatic chambers in propulsion unit 1, FIG. 5, and/or capsule 4. With ISAM hovering over the rough terrain, the crew can work through the bottom of capsule 4 on the rough terrain of aqua soil 2.

FIG. 6 shows ISAM fully surfaced. Stabilizing floats 40 are extended so ISAM become more stable. Fully surfaced, ISAM moves more quickly from one location to another due to decreased water drag. The crew have better vision through the calm water immediately below capsule 4. This gives much better vision than trying to peer through the water column from the surface. A vivid example is looking over the side of a boat into the water which is usually rippled or, when calm, has interfering light or reflections, compared to looking through glass bottomed boats used in certain areas for people to observe underwater sea life etc. This would be beneficial for underwater search and rescue, surveillance of aquatic plants and fish beds, geological studies, surveying and photography.

Figure 7:
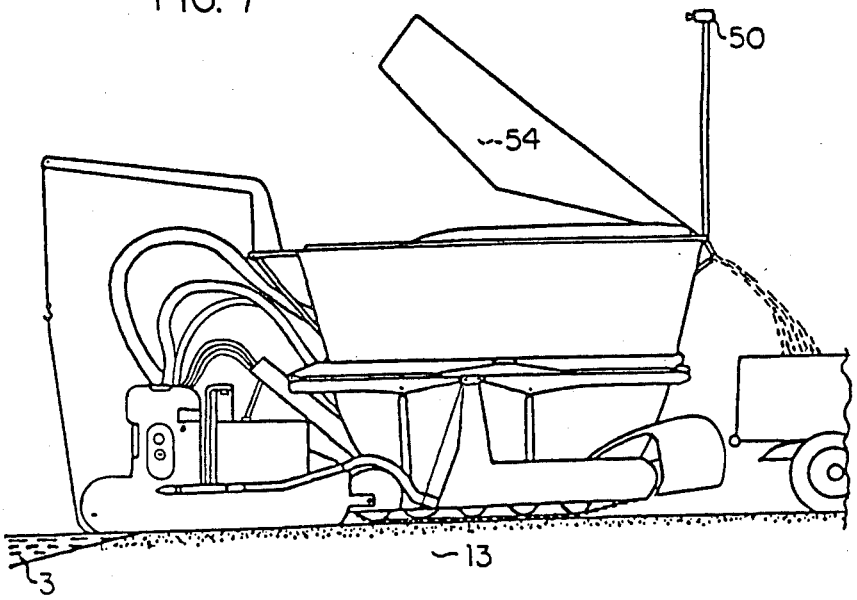
FIG. 7 is a side elevation of ISAM ashore, in its retracted position, showing the storage basket transferring its load into a highway truck.

FIG. 7 illustrates ISAM on land 13 with tilting basket 54 emptying its load into a highway truck or other means. The load can be emptied at another location according to the wishes of the crew. Camera 50 picks up a view of the material emptying out of basket 54.

Figure 8:
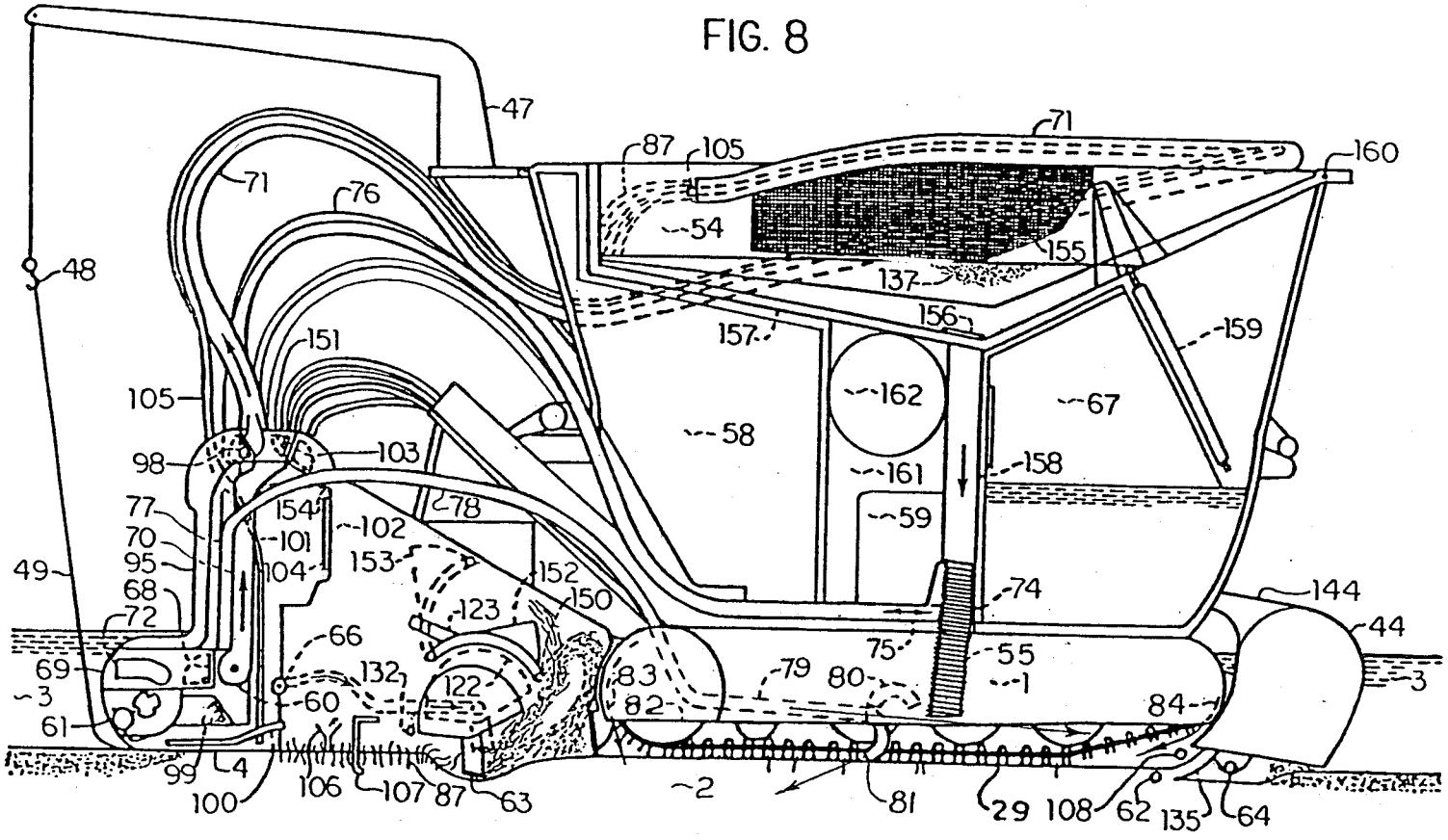
FIG. 8 is a side elevation, partly in section, of one embodiment of ISAM in the retracted position on the aqua soil.

In the embodiment shown in FIG. 8, power plant 59 drives trash pump 60. Power plant 59 can also drive mower pump 61, rod weeder or aquarod weeder 62, roto-tiller or roto-derooter 63, applicator 64 and rotating beater 65, FIG. 12. The last five items are explained in the description relating to FIGS. 9 through 12. Pump 66, FIG. 8, is mainly used to pump clean water. If pump 60 is required to quickly obtain clear water for tank 67 or for jet propulsion when ISAM is in the floating configuration shown in FIGS. 3, 5 and 6 or in between those positions, the crew can open water main gate 68, FIG. 8, allowing water to flow in through main clearer water intake 69 and be sucked into pump 60. Pump 60 can also empty tank 67 quickly by reversing the above system. The normal operation of pump 60 is to transfer solids in suspension into pipe 70 and flexible hose 71, then into basket 54 or into other means. Hose 71 can also be used for direct suction dredging. A suction hose can be controlled outside capsule 4 with revolving crane 47 or be hand operated from within capsule 4 or by any other means.

When operating in unpolluted waters and when ISAM is fully floating, as shown in FIGS. 3, 5 and 6, or anywhere in between, pump 66 takes in water from the small water intake 72, FIG. 8. Extension hoses can be coupled onto intake 69 and/or intake 72, to reach out further when it is necessary to pick up clearer water at a distance. If the machine is operating in a heavily weed-infested area, the crew has the choice of picking up water from either the starboard or port intakes 35, FIG. 1, whichever side is clearer. If clearer water is not obtainable from the surrounding water the crew can obtain it from the reserve in tank 67, FIG. 8, by drawing the water through pipe opening 74, pipe 75, flexible hose 76 and pipe 77 into pump 66 or pump 60.

Capsule 4 can be sufficiently heavy to hold it down on aqua soil 2. In shallow water or on land, tank 67 can be filled with water to given ISAM a counterbalance to counteract the nose-heavy capsule 4. When operating in polluted areas, clean water in tank 67 acts as a reserve for the small orifices such as jets in aquarod weeder 62 and rotor-derooter 63, both explained more fully at FIGS. 10 and 11, or for any other clear water requirements.

Water pumps or other means can be used for directional control and/or propulsion when ISAM is fully floating, as in FIGS. 3, 5 and 6, or anywhere in between. Several propulsion alternatives are available by selecting the most appropriate intakes and/or discharge directions and/or other means. To move from one location to another as fast as possible, FIGS. 3, 5 and 6, and any positions in between, water under pressure can be passed through pipe 77, FIG. 8, through flexible hose 78 and discharged to the stern through pipe 79. Directional changes can be made by reverse deflector 80 in position 81. Propulsion can be assisted by the additional thrust of track 29, with directional control aided by independently varying the speed and/or direction of travel of each independent track 29. In prior art when vehicles are in the water, the upper part of the track creates a reverse propelling action to the lower propelling track action which just neutralizes the propelling force. FIG. 8 shows skirt 82 is low enough to reverse the flow of water on top of track 29 in directions 83 and 84, joining the flow created by the bottom of track 29, which results in the propelling action of the uppertrack 29 adding to the propelling action of the lower track 29.

FIGS. 8 and 9 show mower pump 61 which removes upper plants from water 3. Upper plant 85, FIG. 9, is laid down by the front of the advancing machine. Sickle mower 86 cuts the upper plant 85 off roots 87 which pass under mower pump 61. The action of rotating blade 88, passing over shearing blade 89 chops upper plant 85 into shorter fragments, hereafter referred to as "chopped plant 90". Rotating mower 91 and pressure roller 92 are connected by a gear train or other means to synchronize their meshing. They act like a gear pump creating a high pressure area 93, forcing chopped plant 90 into direction 94 and up into discharge chute 95. This creates a lower pressure in area 96 causing any stray plants 97 and/or particles to be drawn into area 96 by suction through intake 33, where they are engaged by rotating blades 88, FIG. 9. Stray plant 97 is chopped up and forced into high pressure area 93, as are any particles, becoming chopped plant 90 and/or particles, then forced in direction 94 and up into discharge chute 95.

FIG. 8 shows discharge chute 95 up which chopped upper plant 90, FIG. 9, travels, through chute gate 98, FIG. 8, into hose 71 to be discharged into basket 54 or into other means.

The mower pump chamber or any other scoop means may be used to pick up any small material from the aqua soil or that which is in suspension in the water column. Gate 99 can be opened allowing pump 60 to force the material up pipe 70 at a high pressure than would be obtained by going up chute 95 directly into hose 71 and into basket 54, or into other means.

Detector 100, FIG. 8, is provided for detecting object, gases, minerals and the like, and scans from one side of capsule 4 to the other side to detect whatever substance that particular detector is sensitive to. Detector 100 enables the crew to stop ISAM before any damage is sustained by either the vehicle or the crew. When an obstacle is detected, capsule 4 is carefully raised and/or lowered over the obstacles in control station 101 area or in separation chamber 102. If small obstacles are to be removed from aqua soil 2 they can be man-handled from control station 101, or larger ones from chamber 102. Chamber 102 can be transformed into an open-bottomed pneumatic chamber and lowered into position over objects which are then either removed by hand, by tether 49 or by other means. Tether 49 pulls hook 48 so that crane 47 or other means can assist in the removal of objects.

Flooded chamber 102, when transformed into a portable, open or closed bottomed pneumatic chamber, can be used for removal of an object, to make adjustments, for repairs, to replace equipment, or for study or work on or in aqua soil 2. Chamber 102 is transformed by closing separation chamber gate 103, and allowing compressed air to enter chamber 102, blowing out the water. Manhole door 104 allows the crew to pass into chamber 102 to perform their tasks on the damp aqua soil 2 in an enclosed and ventilated area so that the crew ar then able to wear regular work clothes in comfortable atmospheric conditions.

With the aid of the portable, open or closed bottomed pneumatic chamber, many other tasks can be accomplished more easily by individuals in their regular work clothes and without special breathing equipment. Chambers can be used for: the study of aqua soils; the placing of structures; the placing of concrete or other materials, some of which can be placed by hose or by other means; assembling construction forms on or in the aqua soil; cleaning up debris by a vacuum hose 105, FIG. 8. Other tasks such as oxy-acetylene cutting, arc welding, cable cutting and splicing, cleaning out reservoirs and harbours, removal of old pilings, cleaning of water intakes, repairing and/or replacing, can be accomplished. Many other tasks can be performed in the field of fisheries, harbour authorities, logging, construction, mining, pipe lines, cables, aqua culture, survey, photography, geology, archaeology, ecology, search and rescue and other related fields. Some of these uses will require modified portable open or closed bottomed pneumatic chamber means.

Ordinary agricultural equipment, which can operate on damp soils in dry air, can be employed with a capsule which puts the crew right down at the job site. New and desirable aquatic plants, seeds, fertilizers or chemicals to kill certains unwanted aquatic plants can be applied directly on or into the aqua soil. Conventional planters or seeders 106, FIG. 8, applicators 107 and 64 for applying liquids, solids, gases, electronic beams or other means of killing off or improving the growing qualities of the soil, or similar means can be used, and are shown in one of their possible locations. Any of these applications is far more acceptable than the present practice of applying such materials from the surface of a body of water, causing contamination of the water column. Higher costs are involved in prior art, due to the inability to place materials exactly where they are required. All materials drift considerably since they are applied from the surface with no means of containment whereas ISAM places the material, through an enclosed compartment, right onto or into the aqual soil.

FIG. 8 shows an open-bottomed pneumatic plow chamber 44, hereafter referred to as "chamber 44", with the aquarod weeder 62 in its engaged position and in its disengaged position 108.

Figure 10:
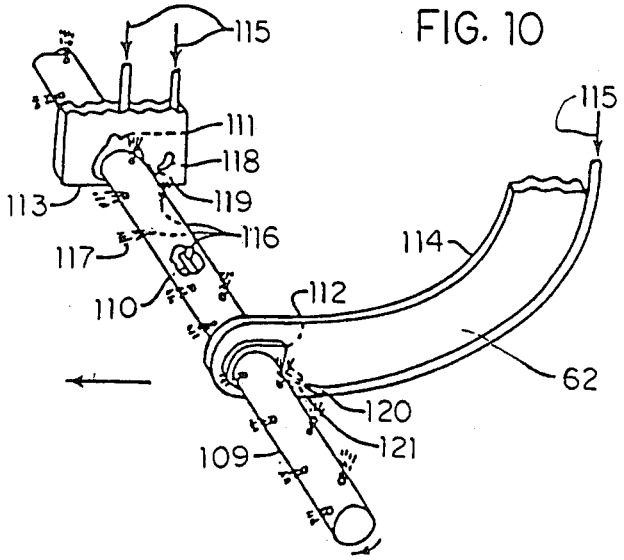
FIG. 10 is a perspective view, partly in section, of a detail of a part of ISAM referred to as the aquarod weeder.

FIG. 10 shows an improved rod weeder, which is a rotating rod dragged or pushed through the soil while the rod rotates dislodging roots. Conventional rod weeders do not work satisfactorily in moist soil conditions. Damp roots and wet soil tend to hang up on the rotating rod and its supports. The improved aquarod weeder 62 is a rotating tube or rod 109, which can be of any shape. It can be either solid or hollow with a passage 110 down the center. Rod 109 is supported at bearing 111 and 112 by drive legs 113 and standards 114 respectively. Pressurized liquid 115 enters rod 109 inside drive leg 112 and/or standards 114 then is discharged through several nozzles 116 creating jet stream 117 to clear off any roots or solids which are hung up on rod 109, on drive legs 113 or on standards 114. At least one nozzle 116 would supply pressurized liquid to lubricate bearings 111 and/or 112. External nozzle 118 sprays jet stream 119 on to drive leg 113 and external nozzle 120 sprays a jet stream 121 onto standards 114 to clear them of solids and roots. A horizontal cable, chain or other means could be placed across the machine below the aqua soil 2 to extract the roots.

Figure 11:
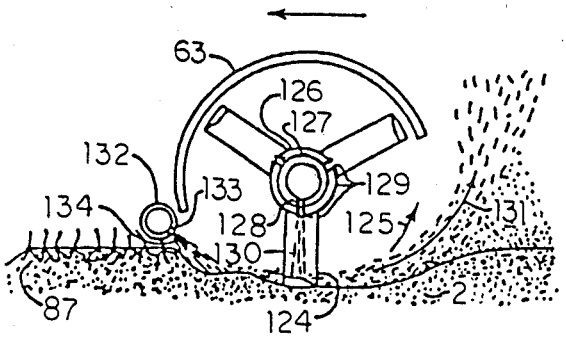
FIG. 11 is a side elevation in section of a detail of a part of ISAM referred to as the rotor-derooter.

Rotor-derooter 63, FIG. 8, is shown in its engaged position and is disengaged at position 122, being illustrated in one of its possible locations. The raising and lowering of roto-derooter 63 is accomplished by hydraulic cylinder 123. The blades 124, FIG. 11, are simlar to those of a conventional agricultural rotor-tiller and turn in direction 125, being mounted on revolving tube 126, but which could revolve in the reverse direction. Revolving tube 126 turns on a fixed tube 127. Water under pressure from pump 66, FIG. 8, enters fixed tube 127, FIG. 11, which has orifinces 128 located in it. Orifices 128 line up with nozzles 129 mounted on revolving tube 126. The lining up of orifices 128 with the alternating locations of nozzles 129 during their revolutions allows the pressurized water to pass through nozzles 129 located to give the most effective blasts of jet spray 130 to assist blades 124 in dislodging roots 87 etc., from aqua soil 2 in direction 131. A rotating drum with blades around the circumference, or other means, could be used to dislodge roots 87.

A slip clutch or relief valve is employed in the drive mechanism between power plant 59, FIG. 8, and roto-derooter 63 to allow it to stop rotating if it comes in contact with solid objects or with compacted aqua soil which in some cases, when left undisturbed, is not compatible to aquatic plant growth.

One method to dislodge roots is to mount a stationary tube 132 shown just ahead of rotor-derooter 63, FIGS. 8 and 11, allowing water under pessure from pump 66, FIG. 8, to enter stationary tube 132, FIG. 11, and to exit through fixed nozzles 133 to direct jet spray 134 at a suitable angle, assisting blades 124 when necessary to dislodge roots 87 from aqua soil 2. Another method is for stationary tube 132, FIG. 8, to work independently to dislodge roots within chamber 102.

Figure 12:
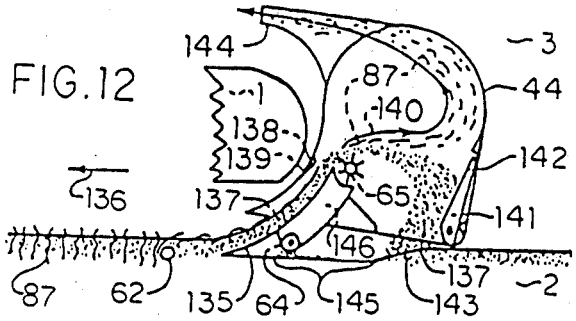
FIG. 12 is a side elevation in section of a detail of an aquarod weeder and plow chamber in the aquatic plant removal mode, with an applicator action.

FIG. 12 is a detail in section showing aquarod weeder 62 which can disengage at position 108 when coming in contact with much more dense soil, a sunken object or the like, to prevent physical damage. It can be used in conjunction with plow blade 135.

As propulsion unit 1, FIG. 12, advances in direction 136, the engaged weeder 62 works the weed roots 87 out of aqua soil 2. A rod weeder on the land lays the weed roots on the top of the soil to dry and die, or to be picked up by some means. In aquatic environment they will not dry out and die so they have to be floated off and removed. This is accomplished by allowing the top layer of aqua soil 2, containing roots 87, to slide up the face of the advancing blade 135, thus removing the portion of aqua soil 2 which contains roots 87. The advancing aquarod weeder 62 assists in drawing the deeper roots 87 to the surface. Soil 137 travels up blade 135 past gate 138 in its open position 139. Roots 87 are beaten out of soil 137 by the rotating action of beater 65. Beater 65 rotates in the direction and at the speed which is most effective to break up soil 137 by the action of the rotating blade and/or cutter means to separate roots 87 from soil 137. Roots 87 floats up in direction 140. The heavier soils 137 fall down past gate 141 in its up position 142, settling down in area 143. During this separation procedure the separated roots 87 are sucked up by pump 60, FIG. 8, through hose 144, FIG. 12, to be disposed of. While the advancing soil 137 travels up and over blade 135 into area 143 there is an area 145 underneath the unit which has the top soil 137 removed from the base aqua soil 2. This combination allows applicator 64 or other means to treat aqua soil 2 in the area shown as area 145 which has not been removed by blade 135. The newly treated aqua soil 2 is then covered by the falling soil 137 in area 143 so that the treated area can also be buried, and whatever has been applied by applicator 64 or other means can remain in the area where it has been placed to either grow or to dissipate through aqua soil 2 with the least effect possible on the water column above. Applicator chamber 146 is a storage compartment for the materials used by applicator 64 and could be connected to another similar compartment with either one or both being pressurized to prevent water 3 from entering and thus contaminating the contents of applicator chamber 146.

Aquarod weeder 62, FIG. 8, rotor-derooter 63 and blade 135 do not all have to operate at the same time to uproot aquatic plants. They can work independently or in any combination depending upon soil conditions and obstuctions on or in the aqua soil 2.

When operating in shallow water, a vacuum may be created in chamber 44, FIG. 8 and FIG. 12, to raise the water level above the surface of the surrounding water. When the water wherein the vehicle is operating is too shallow for roots 87 to float off aqua soil 2 and be sucked up by pump 60, FIG. 8, ISAM proceeds into water only deep enough so that the surrounding water is high enough to allow roots 87 to float off, and the vented chamber 44 is sealed off. As ISAM returns to work in shallow water 3, disturbed roots 87 are able to float off to be sucked up by pump 60. For this application ISAM does not proceed into water 3 which would be lower than the bottom of chamber 44 as this would break the seal by allowing air to enter, breaking the vacuum which is maintaining the higher water table inside chamber 44.

The additional weight of the higher water table inside chamber 44 assists as a counterbalance for heavy capsule 4, FIG. 8, when ISAM is operating in shallow water 3, providing the surrounding water is lower than that in chamber 44 but is not lower than the bottom edges of chamber 44.

Chamber 44 may also be used as a much heavier counterweight to give ISAM another, or an additional, counterbalance to counteract the nose-heavy capsule 4. When working in shallow water or on land, by closing a valve on pump 60 and putting gate 141, FIG. 13, into the closed position 146, soil 137 being heavier than water slides up blade 135 until chamber 44 is filled sufficiently to act as the counterweight. Gate 138 would then be put into closed position 148, FIG. 14, completely closing off the bottom of chamber 44. Aquarod weeder 62, blade 135, applicator 64 and applicator chamber 146 can be retracted and stored clear of ground obstacles.

Figure 13:
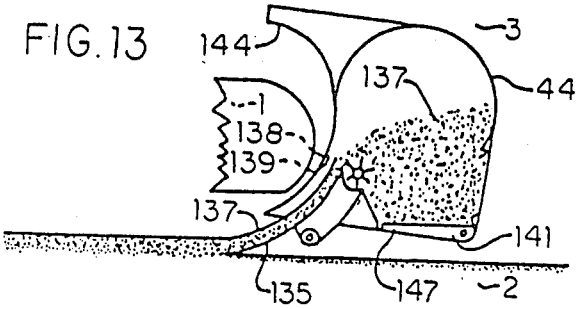
FIG. 13 is a side elevation in section of a detail of the plow chamber in the soil removal mode.
Figure 14:
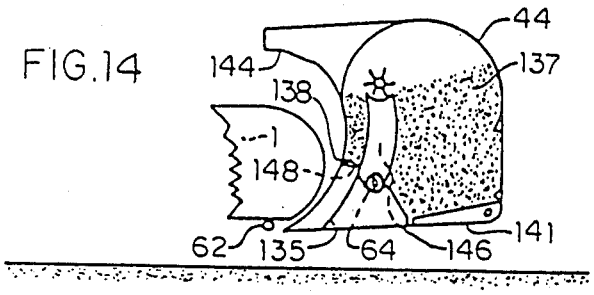
FIG. 14 is a side elevation in section of a detail of the aquarod weeder and low chamber in the soil storage mode.
Figure 15:
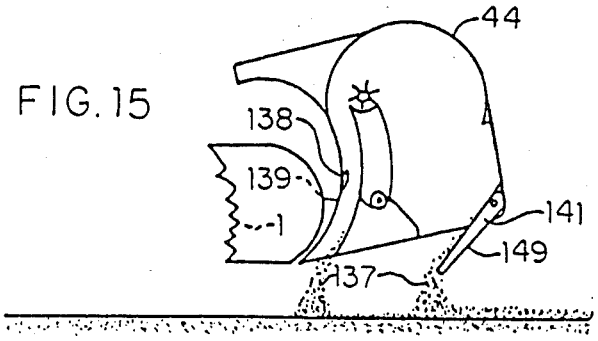
FIG. 15 is a side elevation in section of a detail of the plow chamber in the soil discharge mode.

The last operation can also be used as a method to store soil 137 in chamber 44 or to transport soil from one location to another. When ready to relocate these soils or to discharge the counterweight stored in chamber 44, gate 141, FIG. 15, is lowered to down position 149. Gate 138 is put in open position 139 releasing the contents of chamber 44. If soil 137 in chamber 44 is to be transferred to basket 54, FIG. 8, or to some other means of transport while the bottom of chamber 44, FIG. 14, is in water 3, then gate 138 and/or gate 141 would be cracked open sufficiently to allow a flow of water 3 to enter at the bottom lip of chamber 44 to facilitate a flow of water to move soil 137 through pump 60, FIG. 8, via hose 144. The valve on pump 60, FIG. 8, would be opened and soil 137, FIG. 14, in suspension in plow chamber 44 would move up into basket 54, FIG. 8, or into some other means. If a greater amount of a continual flow of material is required, blade 135, FIG. 13, is reengaged into aqua soil 2, gate 141 is put into closed position 147, and gate 138 is put in open position 139 so that more soil 137 can be pumped through hose 144.

Blade 135 can be used in conjunction with ISAM to scrape soil or aqua soil 2, to push and/or pull these soils to other locations such as in operations for land and/or inshore land reclamation.

Chamber 102, FIG. 8, and chamber 44, FIGS. 8 and 12, being completely enclosed except for an open bottom, allow roots 87 and other small debris dislodged from aqua soil 2 by aquarod weeder 62, FIG. 8, tube 132, roto-derooter 63 or by other means, to float near the surface inside chamber 102 or 44. Pump 60 draws roots 87 through swivel suction intake 150, into pump 60, out pipe 70, up hose 71 and into basket 54 or other means of transport. Intake 150 continually draws more water 3 and its contents in under the bottom edges of chamber 102 so all stray aquatic plants and small floating debris travel into pump 60 and not away from it, this includes upper plants 85 and roots 87, FIGS. 8 and 9. As all of the above are contained, the spread of aquatic upper plants, roots, silt and debris to the surrounding areas is prevented.

If water 3, FIG. 8, in chamber 102 is below a level to give sufficient floatation for roots 87 to be picked up by intake 150, the procedure for creating a vacuum in chamber 102 is similar to that of creating a vacuum in chamber 44, except that ISAM would only have to go out into water 3 deep enough to have the water rise inside chamber 102 to a level for roots 87 to float off aqua aoil 2 in order to be picked up by intake 150. Vacuum gate 151 at the top of chamber 102 would be closed to create the vacuum which would maintain the level of water. In this case less water 3 would be needed in take 67 and/or weight in chamber 44 if they were being used as counterbalances than if the entire chamber 102 had to be flooded. If chamber 102 was to go deeper into surrounding water 3 than the level of intake 150 when there was a vacuum, the vacuum would have to be broken by venting to allow the water to rise. If this was not done, trapped air above the water line would prevent water from rising in chamber 102 creating a situation whereby the deeper ISAM progressed into water 3, up to the full height of chamber 102, the greater the floatation would be. Consequently the breaking force of the propulsion unit 1 would become less efficient for the work ISAM must perform. By releasing the vacuum the breaking force of vehicle 1 can be restored.

The position of intake 150, FIG. 8, should be only sufficiently below the surface of the water inside the chamber 102 so that it does not pick up air and is controlled by the size and location of float 152 rising to its maximum position 153. Under certain circumstances, such as in continuous deep water operations, where the surrounding water is always above the maximum height of intake 150, pipe 154 would be used as a suction intake drawing roots 87 into pump 60, out pipe 70, up hose 71 and into basket 54 or other means of transport.

Upper plant 85 may be removed by mower pump 61, FIGS. 8 and 9, which causes the flowing action of chopped plant 90, FIG. 9, and water 3 just after chute gate 98, FIG. 8. Before it enters hose 71 there is a venturi action which creates a suction at the very top of chamber 102 at the point of vacuum gate 151 and gate 103. With these three gates, 98, 151 and 103 open, dislodged roots 87 float up in chamber 102, through gates 103 and 151 and out through hose 71 without the assistance of pump 60, into basket 54 or into other means of transport.

Equipment attached to hook 48, FIG. 8, which can pick up and hold loads for crane 47, has an automatic release, whereby as soon as the weight is relieved by the load touching the floor of basket 54 or the floor of other transport means, the release is activated. Basket 54 or similar means can be used to store materials such as pipes etc., to be lowered down or retrieved by crane 47 from and/or onto or into aqua soil 2. The basket 54, or similar means, can also be used for such things as concrete being pumped or poured down through a hose such as hose 105 to forms, or other means, on or in aqua soil 2.

All the materials pumped into basket 54, FIG. 8, through hose 71, are suspended in water 3. The surplus water 3 drains out of side screens 155 and bottom screens 156 onto pan 157, when safety chamber 12 is above the water. The draining water falling onto pan 157 drains into pipe 158 and into extendible hose 55 to be discharged into water 3 between tracks 29, thus discharging the water 3 as close to the aqua soil 2 as possible to prevent excessive drift.

An extendible hose 55 can also be adapted to allow the passage of people and/or equipment into propulsion unit 1 and/or a pneumatic chamber from the safety chamber 12 by passing through air-water lock chambers. This passageway can be flooded when necessary.

A method of using hose 105, FIG. 8, to blow debris and/or materials up to the surface in conjunction with a portable open-bottomed pneumatic chamber works on the principle of the pressure differential between a pneumatic chamber and the air pressure above the surface of the water. This method can also be used in chamber 102 if it is first converted into an open-bottomed pneumatic chamber. Hose 105 transfers the debris or material, which continues up into basket 54 or onto other transport means. Basically it can be used as a vacuum cleaner to clean up debris, plants and so forth inside the portable open-bottomed chamber.

When a closed bottomed capsule 4 is desired, a door pasageway could be provided.

Any additional weight in basket 54, safety chamber 12, propulsion unit 1 or other means will assist in counterbalancing nose-heavy capsule 4 when in shallow water or up on land, and would add additional weight to capsule 4, FIG. 2, when on the floor of a body of water to help hold it down.

If aqua soils 2 are to be loaded into basket 54 to eventually be unloaded or transferred to other means of transport, then bottom screens 156, FIG. 8, are closed off to allow soils 137 to build up. Hydraulic lifting cylinders 159 tilt basket 54 at hinge 160 to dump its load into any means of transport or onto various locations, for example, into a highway truck as shown in FIG. 7; into chutes; onto a trailer or conveyor; on shore for land reclamation etc. If ISAM remains in the water, the load can be transferred into another means of transport or emptied onto the aqua soil 2 at another location as for inshore land reclamation. Materials can be transferred directly by crane 47, FIG. 8, by hose 71 or by other means rather than by using basket 54 for the continual transfer of materials while the vehicle advances.

The size of basket 54 is restricted because of the space it takes up in the portable vehicle and because of its weight. It is designed for quick portability for small jobs. Large volume work could require support vehicles or vessels to transfer materials. The size of basket 54 provides sufficient space during possible time loss periods whilst support vehicles or vessels are shuttling, thus assuring a steady and productive operation.

Engine room 161 contains both power plant 59 and air reserve tank 162, which supply electronic power and compressed air for the crew through hoses 25 and 26, FIG. 1 to capsule 4. Compressed air is used to supply all the open and closed bottomed pneumatic chambers and ballast tanks as required.

As capsule 4 and propulsion unit 1 travel into water 3 all major pipes, hoses, chutes, water pumps and areas not required to be pneumatic are flooded. The added weight of said components helps to hold the pneumatic chamber, capsule 4, down on the aqua soil 2.

To surface propulsion unit 1 and capsule 4 without the aid of hydraulic cylinders 27 and 28, FIG. 1, floatation is created by closing chute gate 98, FIG. 8, and the flapper valves on intake 33, FIG. 1. Compressed air is allowed to travel into mower pump 61, FIG. 8, pushing out all the water up to the top of discharge chute 95, creating forward pneumatic chambers in the areas of mower pump 61 and discharge chute 95. This procedure which is the same as blowing out ballast tanks applies to chambers 102 and 44, stabilizing floats 40, FIG. 1, vehicle arms 18 and in all the areas of propulsion unit 1 above the side skirts 82, FIG. 8. Any and/or all of the above can become either partial or complete pneumatic chambers or ballast tanks.

To create a varying bearing load on tracks 29, compartments could be partially or fully flooded with water or other means, proportionately to the bearing load required on aqua soil 2.

Vehicles similar to ISAM can be used as support vehicles when ISAM is out in the water in order to transport a large volume of material. These vehicles can be similar to ISAM, except for their inability to extend down onto the aqua soil and are in the form of amphibious trucks. Thye have means of transferring materials to and/or from regular above ground means of transport or to locate the materials elsewhere, travelling from water up onto land and vice versa. They can also be used to transfer materials out over the water from one location to another as in inshore land reclamation. In such units the cab for the driver is above water, instead of being in an open-bottomed pneumatic chamber. Track 29, or other means, is fastened firmly to the underside of safety chamber 12, with a dump basket 54, or other means, either as part of or mounted on safety chamber 12.

FIGS. 16, 17 and 18 show an arrangement for the utilization of compressed air for the operation of the control system. This novel arrangement can be used in combination with ISAM or any other means but is not the only means by which ISAM's control systems can be controlled. The compressed air can be used as breathing air for the crew, for the pressurizing of pneumatic chambers, or for other means.

Compressed air passages are used to control the various actuators of ISAM or any other device. Fingertip touch control, or small valves, open and/or close small compact passages to remotely perform functions and to reduce the size of components in the confined space of the crew's work area, resulting in a saving of cost and space, as compared to the prior art of large controls and passageways in relatively confined quarters.

An air storage tank may be used as a reservoir in the passageway after the compressor but before the aforementioned touch control. The reservoir absorbs some of the pulsations of the compressor, steadying the air flow and serving as a reserve air supply for the breathing air of the crew. The reservoir also acts as reserve air to supply pressurized air to blow out the ballast tanks in safety chamber 12, FIG. 5, air for the pneumatic chamber and to provide air for said touch control system in the event that the compressor shuts down for a period of time. This allows the functions to continue safely, using the reserve air supply. Because this is normally an open system with air flowing into the area where the crew is located, it is only when a member of the crew chooses to close a passage that a function takes place. If the closed passage has a break in it then this function ceases.

After the operator closes a passage making it a closed system but in fact some problem has occurred, such as door 104 being not closed sufficiently, a passage is now open, allowing air to escape, therefore the system will not function, preventing physical damage to crew and/or equipment.

FIG. 16 shows the basic principle of this touch control system. Compressed air flow through pipe 163, and is divided by tee 164 into passages 165 and 166 through restrictive flow controls 167 and 168, creating a back-up pressure to remain in these passages. The air which passes through said restrictive flow controls continues through passages 169 and 170, through tees 171 and 172, into passags 173 and 174 and escapes out openings 175 and 176. When there is no substantial resistance differential in the two different sets of passages 173 and 174 and sets of tees 171 and 172 on either side of piston 177 within cylinder 178 or other apparatus, there is no substantial pressure differential on either side of piston 177, consequently no function. When the operator blocks opening 175, air pressure builds up in passages 173 and 169, equivalent to that in passage 165 so that it passes through tee 171 into cylinder 178 at that end, creating a pressure against piston 177 causing said piston and connecting ram 179 to move in direction 180 to perform a function such as the directional control of an actuator. By removing the blockage in opening 175, which releases the pressure built up against piston 177, and by blocking opening 176, the operator allows pressure to build up in passages 174 and 170 so that it passes through tee 172 into cylinder 178 at that end, creating a pressure build-up this time on the opposite side of piston 177, thus causing said piston and ram 179 to move in direction 181 which is the reverse of the above operation. When both openings 175 and 176 are unblocked ithe air is allowed to escape so that said piston and ram are free to float in either direction, such as in a situation where the control openings 175 and 176 control pneumatic cylinder 178, for operating a hydraulic control valve which is spring loaded to return to neutral. If the air pressure is low, the pressure of a single finger on the control openings 175 or 176 is sufficient to operate cylinder 178.

FIG. 17 shows a flexible membrane 182 with directional markings over the control openings 175 and 176 and secured by fastenings 183 to the control panel 184, thus allowing the escaping air to disperse sideways such as in direction 185. When pressure is applied on membrane 182 at the required pressure points 186 or 187 to close openings 175 or 176, the pressure on said membrane completes the closure. Conventional valves could be used to block and unblock said openings. Many single or multiple passages could be set in control panel 184. A single acting cylinder can be operated by just one side of the system.

In FIG. 16 the restrictive flow controls 167 and 168 can have their flow adjusted to vary the speed of ram 179 in either direction 180 or 181.

FIG. 18 shows one example of a control system that can be used in ISAM. Numerous single or double acting penumatically operated devices could be used using the same basic principle. A simple system of passages can remotely control a function in the vehicle, by a push pull action of piston 177 and ram 179. Compressed air flows through pipe 188, FIG. 18, and enters compressed air storage tank 189 to lessen the pulsations of the air compressor and also to ensure that a reserve supply of air is in storage to operate all functions if the air compressor is shut down. The air is discharged through pressure regulator 190 into the remote control system as explained in detail, FIGS. 16 and 17.

By blocking off openings 175 and 176, FIG. 18, that portion of the system is closed. This enables the use of openings 191 and 192 by tiltable means such as pedal 193 or other apparatus which has means to bring the control into a neutral position. These means allow that when not in use the foot pedal 193 is in a neutral position allowing both openings 191 and 192 to be open. The escaping air from both passages 173 and 174 can pass down passages 194 and 195 and out through openings 191 and 192 respectively, not allowing pressure on either side of piston 177 and ram 179 to build up, so that no device is in the engaged position. When the operator tilts pedal 193 about axle 196 in direction 197 to block opening 191, pressure builds up in passages 194, 173, 169, through tee 171 into that end of cylinder 178, forcing piston 177 and ram 179 in direction 180 thus actuating any attached device. When the operator tilts pedal 193 slightly, or other means, in direction 198 about axle 196 it unblocks opening 191 and allows air pressure to escape from that side of piston 177. The tilting of pedal 183 slightly further, blocks opening 192 so that air pressure builds up in passages 195, 174, 170 and through tee 172, passing into the opposite end of cylinder 178 and moving piston 177 and ram 179 in direction 181, thus actuating any attached device.

Passages 199 and 200, with openings 201 and 202, are connected to cylinder 178, one at each end. Openings 201 and 202 are blocked by seat 203 or other means. Should the crew member get off seat 203, or other means, an additional safety feature of a spring action toward direction 204 about axle 205 would unblock openings 201 and 202, allowing the air pressure to escape thus shutting down the system. The lack of air pressure on piston 177 attached to ram 179 would not allow the operation of any hydraulic motor or other means in this system, or any device that could cause danger to a crew member when the crew member is off the seat. Only when a crew member returns to seat 203, he moves seat 203 in direction 206 about axle 205, thus closing off openings 201 and 202 and only then allowing controls to operate, providing there is not other break in the system.

Any time manhole door 104, FIGS. 8 and 18, is open such as for crew entry into chamber 102, FIG. 8, said chamber is pressurized with air and becomes an open or closed bottom penumatic chamber. The crew would no want ISAM to move for the safety of a crew member in said chamber. This is accomplished by providing two safety passages 207 and 208, FIG. 18, with openings 209 and 210 connected to cylinder 178, one at each end. Openings 209 and 210 are set in the edge of door frame 211 in such a manner that when door 104 is closed in direction 212 about hinge 213, the lip of door 104 blocks passages 207 and 208 allowing the system to engage through either the openings 175, 176, 191, 192 or other control valves. When door 104 is opened in direction 214 about hinge 213 the blockage on openings 209 and 210 is removed so there is no air pressure on either side of piston 177, thus preventing its operation or that of any device connected to it. Other devices can be controlled by remote passages 215 and 216 with openings 217 and 218 controlled by remote control panel 219. These passages 215 and 216 are connected, one to either side of piston 177, to operate other devices in the same manner or to shut down the system when the openings 217 and 218, with or without membrane, on panel 219 are opened.

The air entering the capsule through said passages can be part of the compressed air used to pressurize the capsule and for the breathing air, or the systems can be independent of each other.

In prior art, submersible manipulating arms which grab and manipulate objects outside the submersibles cannot be stored inside the hulls, so they are awkward and can become entangled with outside things such as aquatic plants etc. The crew in control station 101, FIG. 19, operate manipulating arm 220, which, when not in use, is stored even with or above the lower edge of capsule 4, or other means. When manipulating arm 220 is in stored position 221 it allows capsule 4 to settle down on aqua soil 2 as in position 222. When capsule 4 is lifted up as in position 223, manipulating arm 220 is lowered below the bottom of capsule 4 and can extend out to grab or place objects, rotate the objects as shown in rotation 224, raise or lower as in direction 225 or travel to other positions or swing as in rotation 226, FIG. 20, with claw 227, FIGS. 19 and 20, or other means. One application is to handle a dredge hose 228, FIG. 20, showing the reversible swing of travel 226. Claw 227, FIG. 19, rotates, places or removes objects as in position 229 so they can be handled in chamber 102 or in any pneumatic chamber or flooded compartment.

ISAM can be used as an aqualog skidder, FIG. 20, to retrieve sunken logs etc. ISAM can be driven out into the water on the aqua soil where the log or logs to be recovered can be seen first hand. When a line, or other means, is secured, the logs may be dragged up onto the land similar to the way a log skidder performs its work in the bush. Prior art is to drag for logs etc., with grappling hooks, working blindly from the surface of the water or in the slow and dangerous way of using divers.

Manipulating arm 220 in position 230, FIG. 20, shows claw 227 or other means, skidding a submerged log 231 along the floor of a body of water and up on to the land like a log skidder, as the prior art does up on land.

Figure 19:
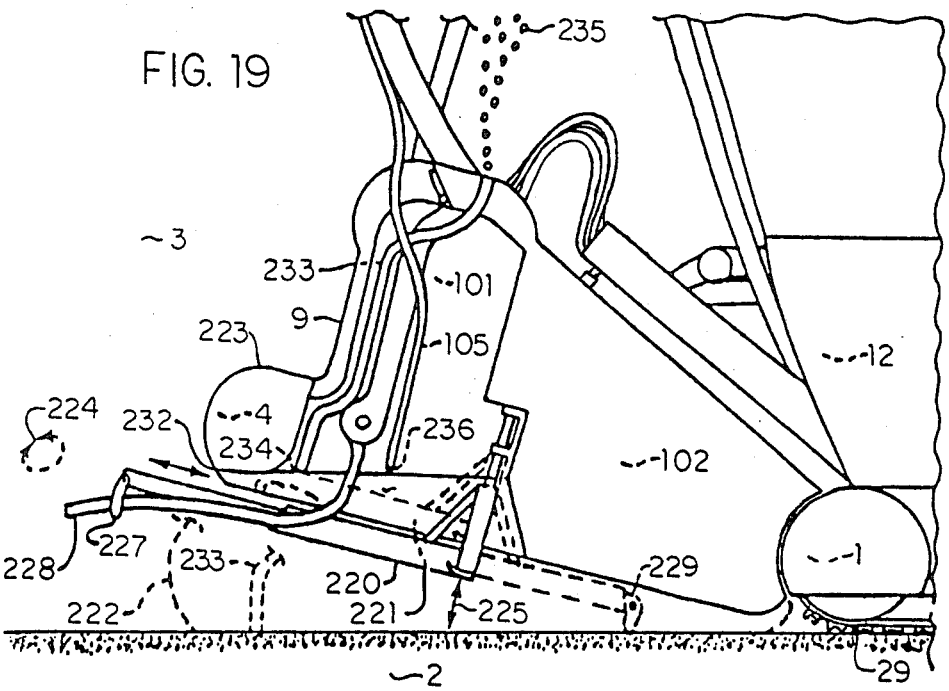
FIG. 19 is a side elevation, partly in section, of ISAM with capsule tilted up from aqua soil and a rotating and revolving manipulator arm.
Figure 20:
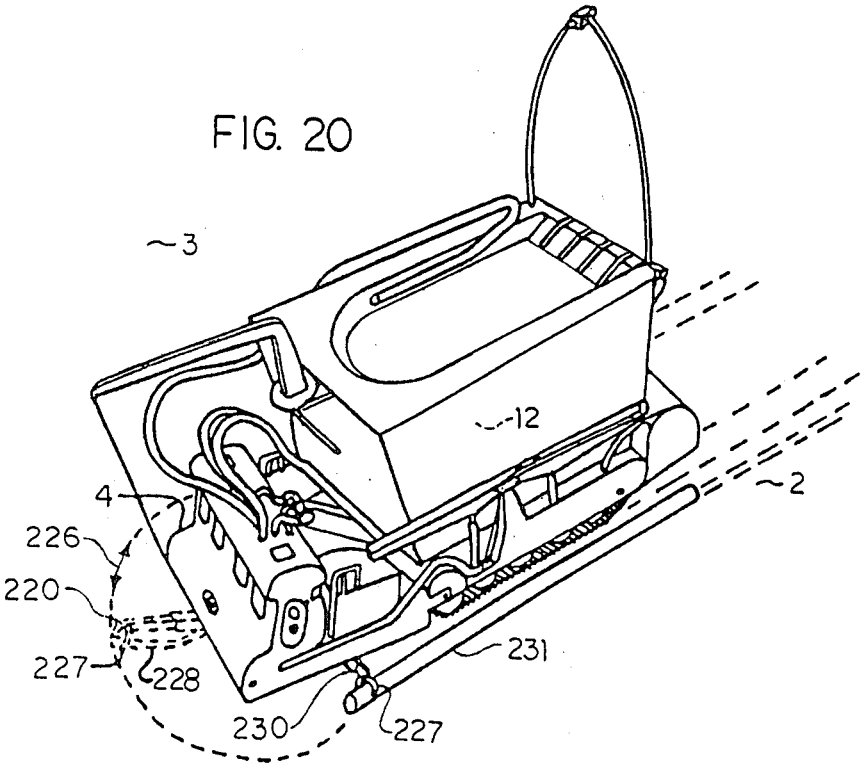
FIG. 20 is a perspective view of ISAM with a revolving manipulator arm in a log skidder mode.

When capsule 4, FIG. 19, is tilted up as in position 223, the surplus air that is pumped down into control station 101 would normally bubble out at the highest point 232 of the capsule 4 bottom edge, causing a flow of bubbles in front of the viewing windows 9 impairing visibility through the water. However, using by-pass hose 233 which always maintains a height at point 234 just above the highest edge of the bottom of capsule 4, surplus air going into capsule 4 is directed to go out of this highest openign by by-pass hose 233 which allows bubbles 235 to be discharged aft and above any viewing windows 8, 9, 10 and 11, FIG. 1, or other means, keeping the water clear of bubbles which would block the operator's view.

Vacuum cleaning hose 105, FIG. 19, relies on the pressure differential between capsule 4 and the atmospheric air above the water to function. Cleaning hose 105 functions inside capsule 4 at point 236 or above, which is higher than water 3 under capsule 4.

Figure 21:
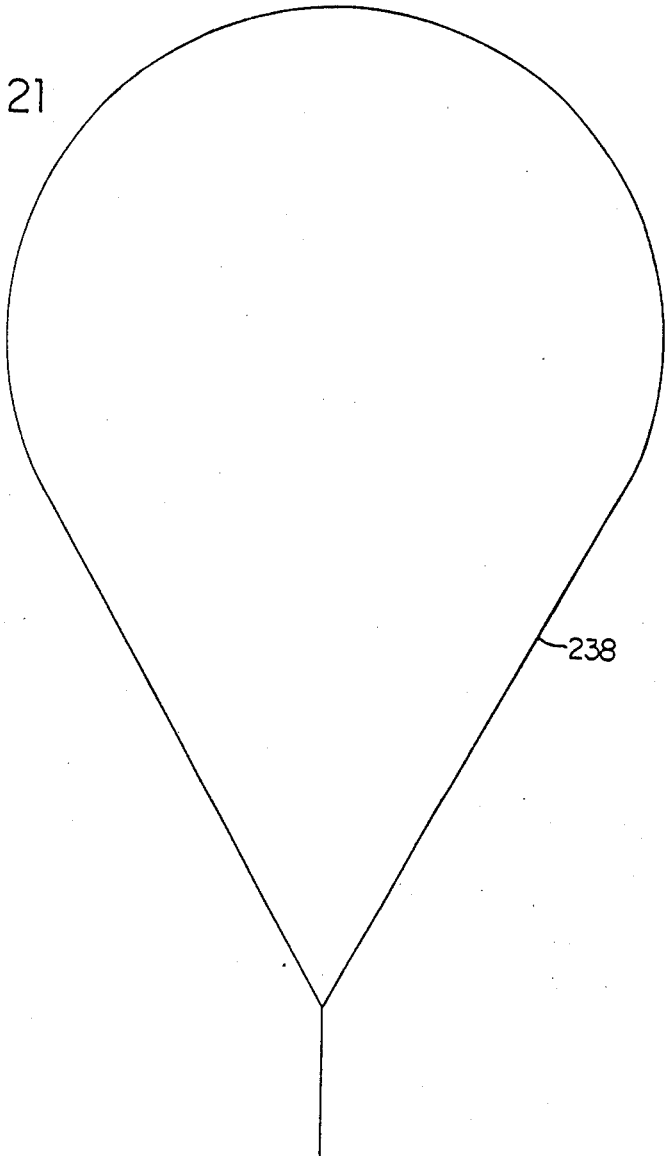
FIG. 21 is a side elevation of ISAM being transported entirely by means of a lighter than air balloon or other means.

FIG. 21 shows how ISAM could be moved over obstacles 237, water 3, land 13, or over marshy land upon which the propulsion unit 1 could not normally travel. A Balloon 238, or other means, woudl carry ISAM by cables 239 and be propelled from one location to another by a shrouded propeller 240 or by other means until such time as ISAM could operate on land or in the water 3.

Figure 22:
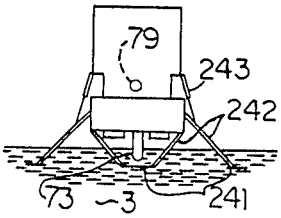
FIG. 22 is an end elevation of ISAM being supported out of the water by hydrofoils or other means.

FIG. 22 shows how ISAM could be moved from one lcoation to another above the surface of water 3 at a high speed, with the use of hydrofoils 241. Hydrofoils 241 could be supported by struts 242. Struts 242 could be retracted by cylinders 243 when hydrofoils 241 are not being used. Propulsion could be provided by water jets or other means. Water is drawn through extension pipe 73, through intakes 72 and/or 69, FIG. 8, and discharged through pipe 79, FIGS. 8 and 22, for propulsion, or by other means.

Figure 23:
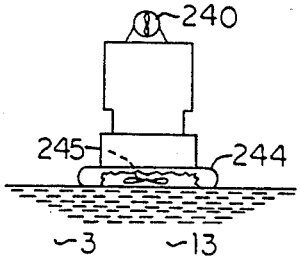
FIG. 23 is an end elevation of ISAM supported above the water or land by an air cushion or other means.

FIG. 23 shows how ISAM could travel over land 13 such as soft marshy land and water 3 with greater speed and less surface resistance. The air cushion skirt 244 encloses compressed air obtained from the air stream from propeller 245, or other means, giving a lift to ISAM allowing it to travel on a cushion of air. Movement from one location to another by riding on the cushion of air could be accomplished by the shrouded propeller 240 or by other means.

All or part of the functions of these systems can be controlled by a computer or other means.

Figure 24:
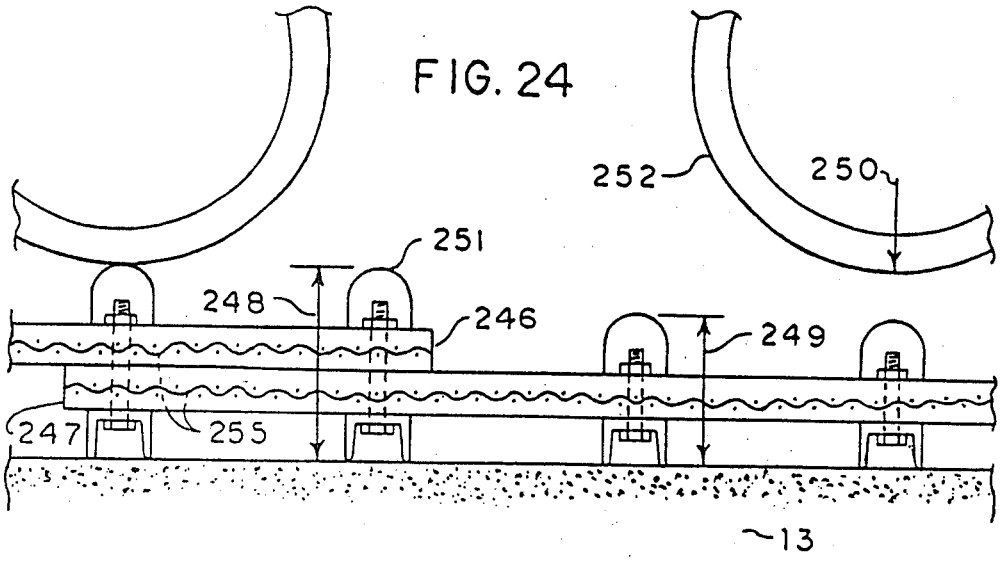
FIG. 24 is a side elevation of a detail section of track in prior art.

In prior art when belting of tracked vehicles is made of reinforced rubber or similar belting it is spliced together to make a continuous belt by over-lapping the ends or by the use of end hinges clamped or riveted to the ends of the belt. FIG. 24 shows the disadvantage of the lap splice. By the belt ends 246 and 247 overlapping, the belting is increased to thickness 248 instead of being thickness 249. This causes a bouncing effect 250 when grouser bars 251 and cleats 260 pass between wheels 252 and compact aqua soil and land 13. Another disadvantage is that the shear strength is low between the two contacting rubber or similar belting surfaces. The disadvantage of end hinges is that they can tear out of the belting.

Figure 25:
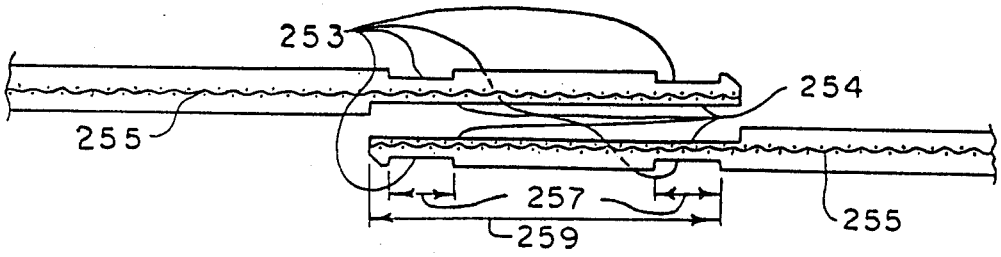
FIG. 25 is a side elevation of a detail section of track belt, unassembled.
Figure 26:
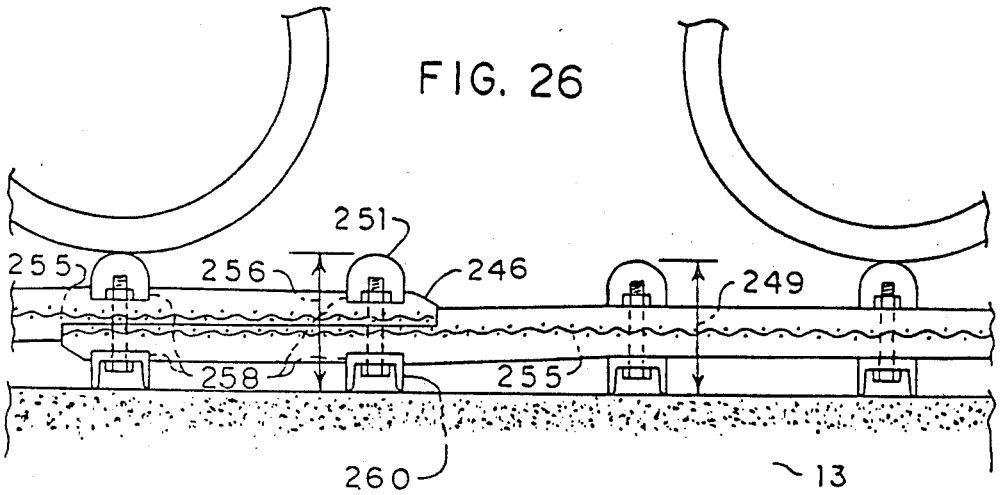
FIG. 26 is a side elevation of a detail section of an improved track belt, assembled.

FIG. 25 shows that by reducing the thickness of the reinforced rubber of similar belting at location 254, it allows the reinforcement 255 to come closer together, compared to the distance between the reinforcement 255 shown in FIG. 24. Grooves 258, FIG. 26, in belting at location 253, FIG. 25, improve the shear strength by the width of locations 253 for the distance 257. Thickness 256, FIG. 26, becomes equal to thickness 249 preventing the bouncing effect 250, FIG. 24.

Bonding the lap by vulcanizing, riveting or other means for the distance 259, FIG. 25, further increases the shear strength for the full length of distance 259. The grouser bars 251, FIG. 26, and cleats 260 in grooves 258 in the belting tend to also increase the shear strength but not as much as the shear strength in the overlapping of the said reinforcement above, due to the lower shear strength of rubber as compared to most of the reinforcement used in rubber or similar belting.

FIG. 1 shows ISAM in one embodiment where it is advantageous to have capsule 4 and plow chamber 44 the full width of ISAM in order to take advantage of work requiring its full width, such as for aqua culture, aquatic plant removal, archaeology, geology, photography, search and rescue etc. An advantage of ISAM as shown in the embodiment of FIGS. 27, 29, 30 and 31 is that the open or closed bottomed pneumatic chamber capsule 4 is supported between tracks 29 of propulsion unit 1 thus establishing a more suitable weight balance control for this embodiment, by positioning the center of gravity of capsule 4 near or over the center of gravity of propulsion unit 1 and beneath the center of buoyancy of safety chamber 12. Another advantage of the embodiment is that it is possible to have capsule 4 straddle or hover just above lengthy objects without the interference of tracks 29 while working on long objects such as pipe-lines, cables, logs or other elongated things. Another advantage is that capsule 4 can be lifted straight up or down or tilted in any way by lifting mechanism shown and described with FIG. 30.

ISAM as shown in FIGS. 27, 29, 30 and 31 has all the other capabilities of ISAM as previously shown in FIG. 1 plus the additional advantages referred to above.

Figure 27:
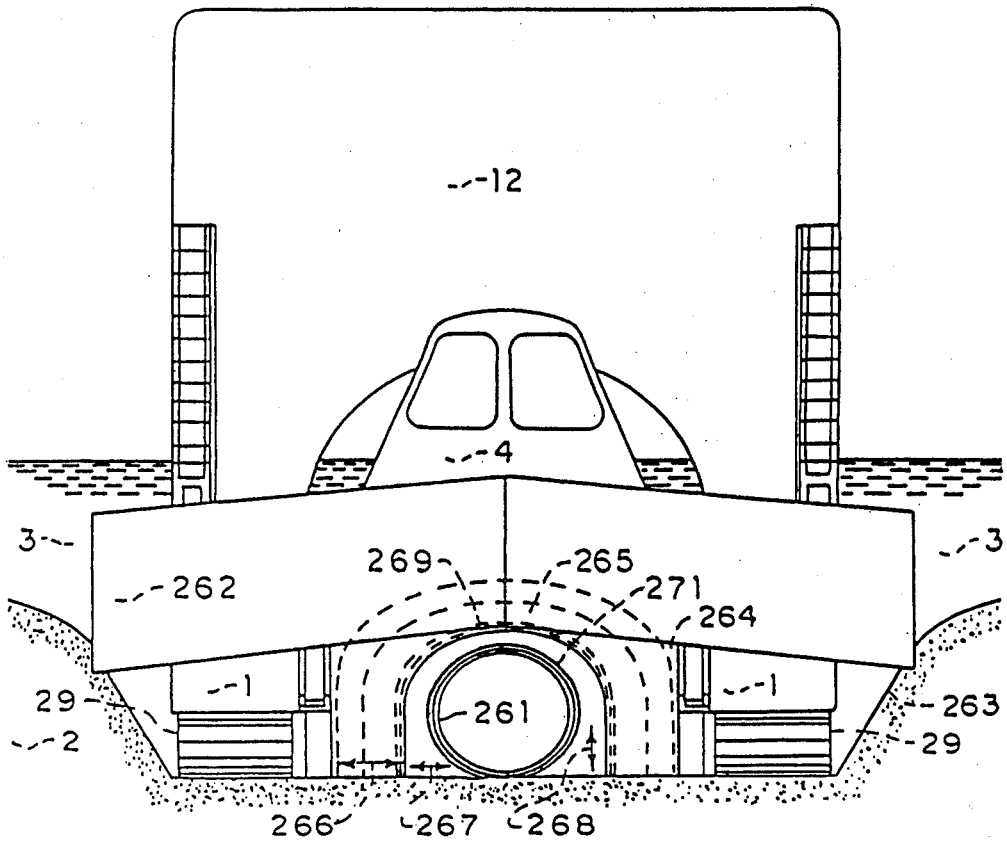
FIG. 27 is an end view of one embodiment of ISAM, partly submerged, in a retracted position on the aqua soil showing the capsule as being between two connected tracks of a propulsion unit.
Figure 28:
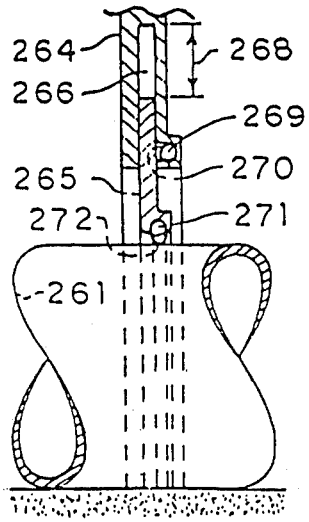
FIG. 28 is a cross section of the detail of a sealing plate to close in an external wall of a capsule with a pipe passing through it.

FIG. 27 shows capsule 4 straddling a pipe-line, cable or similar object, hereafter referred to as pipe 261, in its position to be worked on, monitored, X-rayed, inspected, repaired, to be positioned or removed etc. If pipe 261 is to be buried below aqua soil 2 plow blade 262, or other means, can trench aqua soil 2 similar to trench 263. Pipe 261 or sections of pipe 261 could then be placed in trench 263. To keep most of the compressed air inside capsule 4 a seal plate 265, also shown in FIG. 28, with a hole through it to allow pipe 261 to pass through, is placed around the circumference of pipe 261 to seal said pipe as it enters and/or exits one or both walls 264 of capsule 4. Wall 264, FIGS. 27 and 28, has a slot 266 in it to allow for movement, in directions 267 and 268, of seal plate 265 which encircles pipe 261. Deflated air hose 269 can be pressurized to create a seal between wall 264 and seal plate 265 at point 270 and deflated air hose 271 can be pressurized to create a seal between sael plate 265 and said pipe 261 at point 272 thus sealing the compressed air inside capsule 4.

Figure 29:
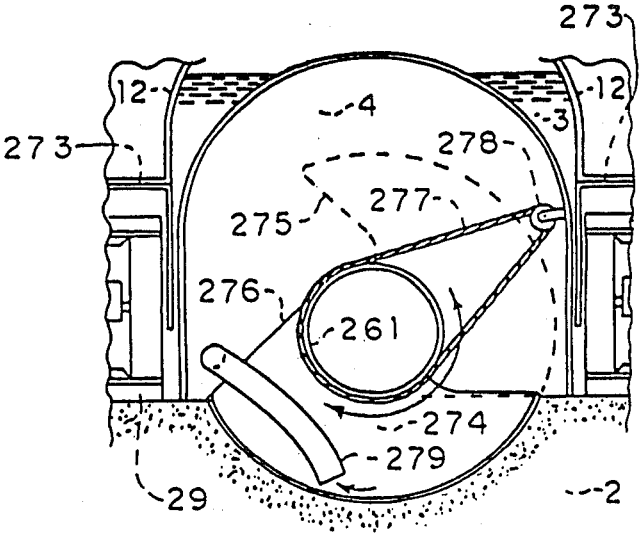
FIG. 29 is an end view of a cross section of the embodiment described in FIG. 27 showing a separate chamber to be used below the surface of the aqua soil.

In shallow water or up on land safety chamber 12, FIG. 29 straddles capsule 4 resting on propulsion unit 1 at locations 273.

Another chamber with two sides to fit the outside diameter of pipe 261 is equipped with a curved bottom for use below the surface of the aqua soil, hereafter referred to as sub-squa soil chamber 274. Said chamber can be rotated around pipe 261 from position 275 to position 276 by a strap 277 or other means operated by winch 278 or other means when aqua soil 2 is composed of soft or moveable material. Suction hose 279 can remove the moveable material and water out of sub-aqua soil chamber 274 or other means, allowing workers and equipment to weld, X-ray, apply protective coating and/or inspect etc., the underside of pipe 261 without the moveable material of the aqua soil caving-in on the work area.

Figure 30:
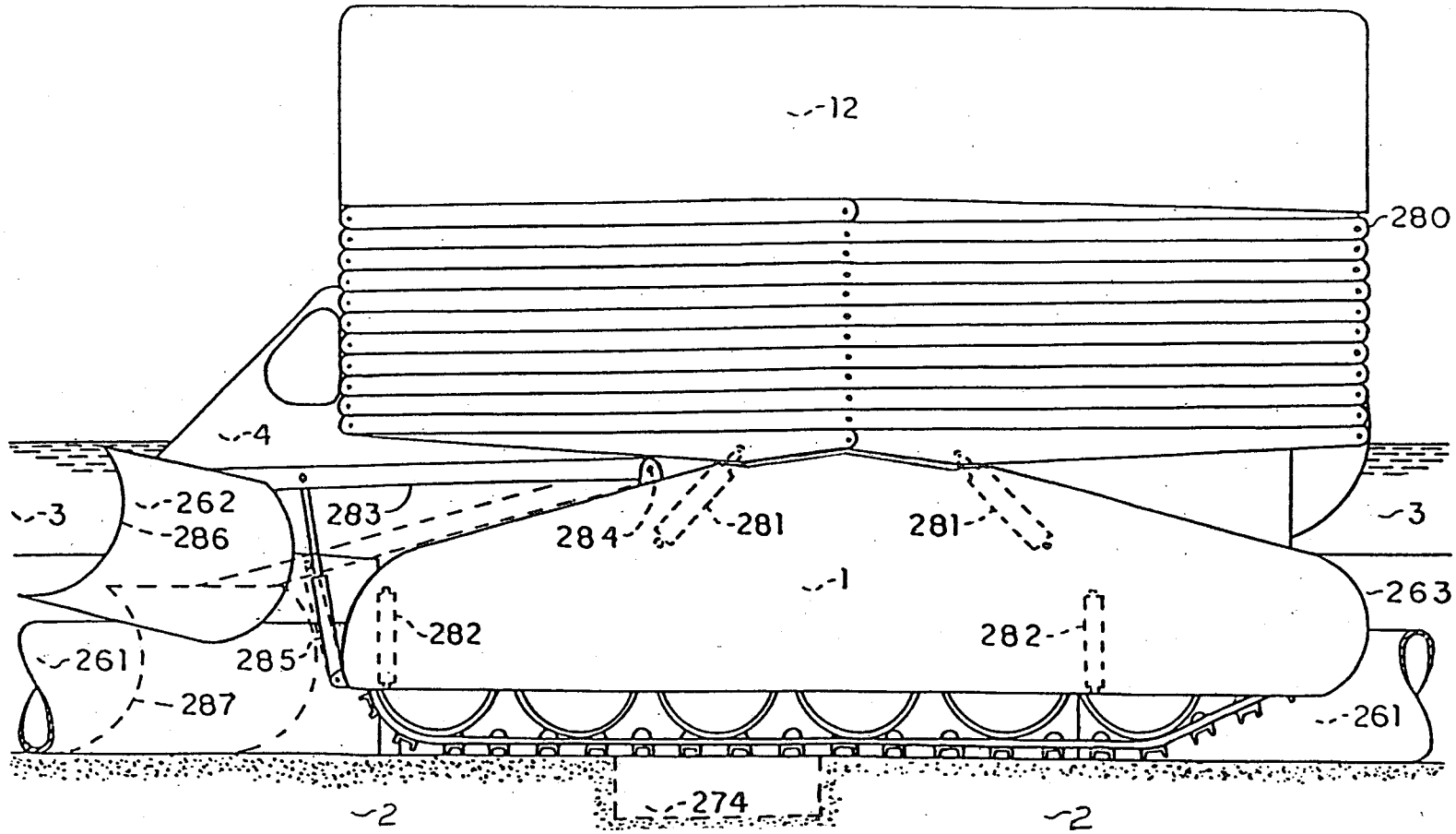
FIG. 30 is a side view of one embodiment of ISAM described in FIG. 27.

In FIG. 30 safety chamber 12 is connected to propulsion unit 1 by multiple linkage 280 similar to arms 14, 17, 20 and 23, FIG. 1 and for the same function and purposes as shown and described with said FIG. 1. The additional multiple linkage 280, FIG. 30 when fully extended allows the underwater capsule 4 and propulsion unit 1 to go into depeer water, right down on aqua soil 2 before safety chamber 12 floats said capsule and vehicle off aqua soil 2.

Adjustable mechanisms 281 have the same function and purpose as cylinders 27 and 28, FIG. 1.

Adjustable mechanisms 282, FIG. 30, or other means, operates the lifting, lowering and tilting of any side of capsule 4. Attached to plow blade 262 are arms 283 which pivot about points 284, or other means, and are adjusted by adjustable mechanisms 285 from a retracted position 286 above pipe 261 to an engaged position 287.

Figure 31:
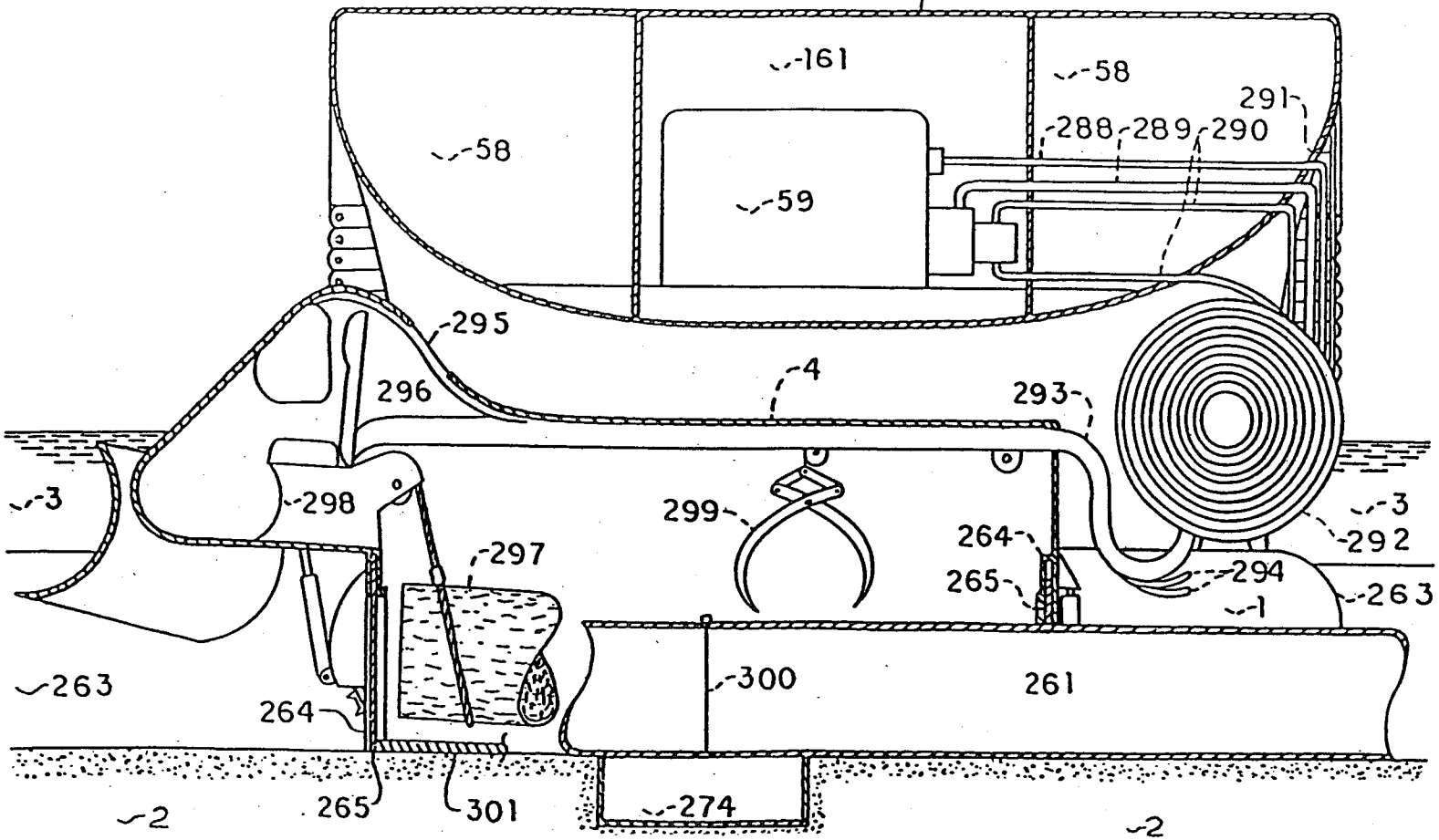
FIG. 31 is a side view, partly in section, of one embodiment of ISAM described in FIG. 27.

Power plant 59, FIG. 31 is shown in engine room 161. Due to the greater depth capability of ISAM shown in FIGS. 27, 30 and 31, all lines such as electrical 288, air 289, hydraulic 290, communication 291 etc., can be extended and/or retracted by using longer lines wrapped around reels 292, or other means, and connected to capsule 4 by flexible lines 293, or other means. Power lines to propulsion unit 1 are connected by flexible lines 294 or by other means.

Window 295, or other means, allows the operator in seat 296 to see aft between reels 282. Seal plate 265 can be with or without a hole for the skidding of logs 297, with a hoist 298 or for other operations. Other hoists 299 can be used to lift and adjust pipe etc., especially for adjusting it to weld up a joint 300 in pipe 261 taking advantage of the sub-aqua soil chamber 274 which is open for access from above. Ballast tank 58 can be used for ballast control as shown in FIG. 8, and described with FIGS. 4, 5 and 8.

An improvement of ISAM is the detail of the closedin bottom 301, FIG. 31 which can be used to partially or completely close off the open bottom of capsule 4, FIGS. 4, 5, 8 and 31, should the submersible amphibious vehicle be required to travel into deeper water such as for offshore operations. The increased pressure of the compressed air which normally keeps the water out of the open-bottomed capsule 4 housing the operators would be too great for the operators to withstand therefore to suit the conditions the said partially closed or completely closed-in bottom would be an improvement for greater depths.

The embodiments of the invention in which an exclusive property or privilege is claimed are defined as follows:

1. A submersible amphibious vehicle comprising: as a self-contained unit means, at least one open-bottomed pneumatic chamber means adapted to house personnel and equipment on land, on water or underwater; a propulsion unit means connected by means to said chamber and provided with means for propelling it on land, in the air, on the floor of a body of water, on the surface of the water, and anywhere in between; a safety chamber unit means resting on said propulsion unit means and connected thereto by an extendable linkage means whereby as said vehicle progresses from dry land into deeper water said propulsion unit means remains on the bottom of said water; said safety chamber means remains on said water surface as said linkage means extends, said safety chamber means being of sufficient displacement to carry said propulsion unit means and said open-bottomed pneumatic chamber means, whreby said propulsion unit means and its attached open-bottomed pneumatic chamber means are lifted from the bottom through said linkage means as the depth of water exceeds the maximum extension of said linkage means.

2. A self-contained, free ranging vehicle capable of travelling on land, in the air, on water, and under water, comprising: endless track driving means for travelling on said land, on and under said water, and along the floor of a body of water; a power unit means for providing motive power to said vehicle on said land, in said air, on and under said water, and along said floor of a body of water; at least one open-bottomed pneumatic chamber means permitting personnel inside to make observations or carry out work under water in conditions compatible with human requirements for extended periods of time, not requiring special clothing or breathing equipment, with unobstructed access to the surrounding water through the bottom of said open-bottomed pneumatic chamber means; a control station means from where personnel can drive said vehicle either on said land, in said air, on or under said water, and along said floor of a body of water in human compatible conditions; means for accomodating personnel in said open-bottomed pneumatic chamber means as said vehicle travels on said land, in said air, on and under said water; means for continuously providing sufficient air pressure to said open-bottomed pneumatic chamber means to force water out of said open-bottomed pneumatic chamber means to maintain said human compatible conditions whereby said personnel can enter said open-bottomed pneumatic chamber means on dry land and remain therein, while wearing normal land type clothing and have unobstructed access to the exterior of said vehicle through the bottom of said open-bottomed pneumatic chamber means as said vehicle travels on or under said water; a safety chamber means which rests on said vehicle when on and out of said water and which is connected to said driving means by an extendable linkage means; said safety chamber means having a buoyancy sufficient to carry the weight of said vehicle, whereby as said vehicle enters said water said safety chamber means remains on the surface, with said linkage means extending until it reaches its maximum extension, at which point said safety chamber means prevents said vehicle from going any deeper into said water.

3. A vehicle according to claim 1, comprising endless track driving means for travelling on said land, on or under said water, and along said floor of a body of water.

4. A vehicle according to claim 3, comprising a control station means for an operator to drive said vehicle either on said land, in said air, on or under said water, and along said floor of a body of water, in conditions compatible with human requirements.

5. A vehicle according to claim 1, wherein said control station means is in said open-bottomed pneumatic chamber means, whereby the operator has unobstructed access to the exterior of said vehicle through the bottom of said open-bottomed pneumatic chamber means.

6. A vehicle according to claim 5, wherein means are provided to continuously supply sufficient air pressure to said open-bottomed pneumatic chamber means to force water out of said open-bottomed pneumatic chamber means to maintain said human compatible conditions.

7. A vehicle according to claim 2, comprising at least one additional open-bottomed pneumatic chamber means, in communication with the first-mentioed open-bottomed pneumatic chamber means through at least one water-tight door means, whereby said additional open-bottomed pneumatic chamber means can provide a larger work area on the bottom of a body of water.

8. A vehicle according to claim 7, whereby said additional open-bottomed pneumatic chamber means can be flooded when not in use as a pneumatic chamber, whereby said flooded chamber means can be used to assist in the removal of aquatic plant means from the bottom of a body of water in a controlled semi-enclosed chamber means preventing the drift of said aquatic plant means.

9. A vehicle according to claim 2, comprising means for regulating the buoyancy of said vehicle such that, in water, it may be located on the bottom, on the surface, or at intermediate levels therebetween.

10. A vehicle according to claim 2, comprising a flooded open-bottomed endless track chamber means covering said endless track driving means, said chamber means comprised of an enclosed top with side skirts and a partial wrap-around skirt at the end of said endless track means, whereby the direction of the flow of water, caused by the travel of the upper portion of said endless track means, is reversed as said flow of water is diverted by the said partial wrap-around skirt at that end of said endless track means, said flow of water joining the direction of the flow of water caused by the lower portion of said endless track means assisting in propulsion, as opposed to neutralizing said propulsion, whereby said endless track means assists in the propelling and steering of said vehicle.

11. A vehicle according to claim 2, comprising thrust means for propelling said vehicle under said water, on the surface or at intermediate levels there-between, wherein said thrust means comprises water jet thruster means.

12. A vehicle according to claim 2, further comprising hollow retractable floatation member means which extended laterally from said vehicle when on the surface to enhance lateral stability.

13. A vehicle according to claim 2, wherein said vehicle also provides a basket means mounted on said safety chamber means, whereby said basket means is used for storage of materials to be placed under water or removed therefrom, said basket having means for discharging its load.

14. A vehicle according to claim 2, further comprising a television camera means mounted on said safety chamber means, said television camera means connected to a monitor means at said control station means to enable said personnel to see above water.

15. A vehicle according to claim 2, comprising water storage means as a part of said safety chamber means whereby said storage means can be partially or completely filled with water adding weight to said vehicle.

16. A vehicle according to claim 2, wherein connecting means connect said endless track driving means to said open-bottomed pneumatic chamber means.

17. A vehicle according to claim 16, comprising acutator means for raising and lowering said open-bottomed pneumatic chamber means relative to said endless track driving means.

18. A vehicle according to claim 2 further comprising actuator means for raising, lowering, and adjusting the angles of, said endless track driving means relative to said safety chamber means.

19. A vehicle according to claim 2, comprising at least one auxiliary pneumatic chamber means connected to said endless track driving means.

20. A vehicle according to claim 19, whereby said auxiliary pneumatic chamber means can be flooded.

21. A vehicle according to claim 20, comprising means for maintaining a partial vacuum in said chamber means when said vehicle is only partly submerged, whereby the water level in said chamber means is maintained by said vacuum means above the level of the surrounding shallow water to allow aquatic plants near the shore to be worked on more effectively while said aquatic plants are submerged.

22. A vehicle according to claims 20, wherein said chamber means has at least one blade means to remove the top layer of soil, said soil passing into said chamber means.

23. A vehicle according to claim 22, whereby said removed soil can be stored in said chamber means.

24. A vehicle according to claim 23, whereby said removed soil can be moved to another location.

25. A vehicle according to claim 2, whereby at least one rotating blade means is used to separate aquatic plants from soil, said aquatic plant being transported through conduit means.

26. A vehicle according to claim 22, whereby after said soil is removed and before said soil is returned to the ground an applicator means treats the subsoil by fertilizing, planting, seeding, chemical application or by electronic beam means to grow or kill plants.

27. A vehicle according to claim 2, whereby a planter means is attached to said vehicle to fertilize, plant, seed or chemically kill aquatic plants at the bottom of a body of water.

28. A vehicle according to claim 2, whereby an applicator means is attached to said vehicle to treat the aqua soil by fertilizing, planting, seeding, applying chemicals or by electronic beam means to grow or kill aquatic plants.

29. A vehicle according to claim 2, further comprising a rod weeder means, whereby said rod weeder means is used for displacing plants from the soil.

30. A vehicle according to claim 29, whereby said rod weeder means can be provided with water jet means to dislodge cut plants adhering to said rod weeder means and the rod weeder support means.

31. A vehicle according to claim 2, comprising a pneumatic control system means whereby said pneumatic control system means has a control panel means located in said open-bottomed pneumatic chamber means for operating actuator means on said vehicle at various locations throughout said vehicle, said pneumatic control system means including a supply of compressed air means for supplying said air means to opposite sides of a piston means in a differential piston-and-cylinder actuator means, and means for venting air on either side of said piston means, whereby, by blocking an air vent means on either side of said piston means, an operator can cause said piston means to be displaced by air pressure and thereby actuate an associated control component means in said vehicle.

32. A vehicle according to claim 31, wherein vent orifice means are located at crew position means in said open-bottomed pneumatic chamber means such that crew members block said vent orifice means when said crew members are in their travelling position, said blocked orifice means allow associated control component means to operate machinery means of said vehicle, whereby on moving out of said travelling position said crew members unblock said vent orifice means thereby relieving the pressure necessary to operate hazardous equipment, causing a shut-down of said hazardous equipment.

33. A vehicle according to claim 13, comprising a hose means extending from said open-bottomed pneumatic chamber means to said basket means for carrying up debris means from below the surface to above the surface, said hose means making use of the pressure differential existing between the surface and said open-bottomed pneumatic chamber means to transport debris through said hose means.

34. A vehicle according to claim 2, comprising a rotary derooter means, having a plurality of radial derooting blade means mounted on a rotating shaft means to dislodge aquatic plant roots to be transported through conduit means.

35. A vehicle according to claim 34, whereby a plurality of radial derooting blade means can be mounted on a hub means rotating on a hollow shaft means, said hub means having orifices at the locations of said blade means, said hollow shaft means supplying pressurized water through orifices in the bottom side of said hollow shaft means, said orifices in said hub means successively coming into alignment with said orifices in the bottom side of said hollow shaft means as said hub means rotates, whereby a jet of pressurized water is directed downwardly on to aquatic plant roots to assist in their dislodgment to be transported through conduit means.

36. A vehicle according to claim 2, whereby roots of aquatic plants are dislodged by jet spray means from a tube means with orifices, said aquatic plants being transported through conduit means.

37. A vehicle according to claim 2, whereby said open-bottomed pneumatic chamber means can be provided with equipment means for working under water.

38. A vehicle according to claim 2, comprising a mower pump means, having a plurality of synchronized meshing roller means, with said synchronized meshing roller means having at least one cutter blade means to chop up the aquatic plants, by the close meshing of said synchronized meshing roller means a high pressure area is created on one side forcing said chopped plant through conduit means to another location, whereby on the opposite side of said synchronized meshing roller means a lower pressure area is created, drawing in any stray plant to be chopped up.

39. A vehicle according to claim 2, comprising a sickle mower means to cut off the upper part of aquatic plants from the roots.

40. A vehicle according to claim 2, comprising a housing means as a means to pick up debris is suspension in the water, or on and in the floor of a body of water.

41. A vehicle according to claim 2, comprising a detector means to detect a selected one of the group of objects, gases or minerals under water.

42. A vehicle according to claim 2, comprising dredging means to remove materials from under water.

43. A vehicle according to claim 2, comprising means of transporting material between above the surface of the water and below the surface of the water.

44. A vehicle according to claim 2, comprising a swivel suction pick-up means whereby, in water, said suction pick-up means has a float means to control the level of the intake of said suction pick-up means.

45. A vehicle according to claim 2, comprising means to lift said vehicle into the air to clear obstacles.

46. A vehicle according to claim 2, comprising means to travel over water faster, by the use of hydrofoil means to lift the main components of said vehicle out of said water.

47. A vehicle according to claim 2, comprising means to travel over water or land by the use of compressed air contained within a rigid or pliable skirt-like structure to create the necessary lift support said vehicle.

48. A vehicle according to claim 2, wherein said endless track driving means are divided so as to allow pneumatic chamber means to be placed between said tracks for operations over lengthy objects to accomplish numerous tasks.

49. A vehicle according to claim 48, comprising means to seal between the walls of said pneumatic chamber means and said objects when said object penetrate said walls of said pneumatic chamber means.

50. A vehicle according to claim 2, further comprising means to allow said safety chamber means to straddle said pneumatic chamber means.

51. A vehicle according to claim 2, comprising a sub-aqua soil chamber whereby said sub-aqua soil chamber is placed below the aqua soil so as to allow access to the lower side of objects laying on or in aqua soil.

52. A vehicle according to claim 2, comprising extendable hose means to transfer materials, water or personnel between said safety chamber and said submerged units.

53. A vehicle according to claim 2, comprising splicing means wherein the strength of endless track belting is increased and whereby uniformity of overall thickness of said belting means and the attached fitting means is obtained.

54. A vehicle according to claim 2, comprising blade means whereby said blade means displaces aqua soil.

55. A vehicle according to claim 2, comprising means whereby multiple linkage means and cable reel means allows submerged units to reach greater depths.

56. A vehicle according to claim 13, whereby said basket means is provided with means to remove water from aquatic plants.

57. A vehicle according to claim 2, comprising thrust means for propelling said vehicle through and on said water and on said land, whereby said trrust means embodies the discharge of compressed air.

* * * * *